US011891791B2

(12) United States Patent
McComas et al.

(10) Patent No.: US 11,891,791 B2
(45) Date of Patent: Feb. 6, 2024

(54) CONCRETE PANEL RESIDENTIAL STRUCTURE SYSTEM AND METHOD

(71) Applicant: Hestia Tech LLC, Indianapolis, IN (US)

(72) Inventors: Charles Rodney McComas, Carmel, IN (US); Allen Mills, Knightstown, IN (US); K C Cohen, Indianapolis, IN (US)

( * ) Notice: Subject to any disclaimer, the term of this patent is extended or adjusted under 35 U.S.C. 154(b) by 71 days.

(21) Appl. No.: 17/722,799

(22) Filed: Apr. 18, 2022

(65) Prior Publication Data

US 2022/0341150 A1 Oct. 27, 2022

Related U.S. Application Data

(60) Provisional application No. 63/178,268, filed on Apr. 22, 2021.

(51) Int. Cl.
*E04B 1/04* (2006.01)
*E04H 9/14* (2006.01)
*E04B 1/38* (2006.01)

(52) U.S. Cl.
CPC ..... *E04B 1/043* (2013.01); *E04B 1/388* (2023.08); *E04H 9/14* (2013.01); *E04B 2001/389* (2023.08); *E04B 2103/02* (2013.01)

(58) Field of Classification Search
CPC .... E04B 1/043; E04B 1/388; E04B 2001/389; E04B 2103/02; E04H 9/14; E04H 9/021
See application file for complete search history.

(56) References Cited

U.S. PATENT DOCUMENTS 3,691,710 A * 9/1972 Gilbert ..... E04C 2/06 52/262
4,443,992 A * 4/1984 Shechter ..... E04B 1/3483 52/506.05
4,506,428 A * 3/1985 Gerhard ..... B28B 7/0029 52/745.1
5,134,828 A * 8/1992 Baur ..... E04B 1/4157 52/704
5,138,813 A * 8/1992 Cooney ..... E04C 2/382 52/704
5,487,241 A * 1/1996 Gorrell ..... E04B 1/043 52/92.1
5,806,273 A * 9/1998 Kaminski ..... E04B 5/04 52/286
5,845,441 A 12/1998 Swartz
5,881,527 A * 3/1999 Haseotes ..... E04B 5/023 52/705

(Continued)

*Primary Examiner* — Rodney Mintz
(74) *Attorney, Agent, or Firm* — Overhauser Law Offices LLC

(57) ABSTRACT

Precast concrete residences resist great hurricane wind forces and moderate seismic forces. The entire residential structure, excluding the slab on grade are made from plant-cast concrete panels. Foundation panel joints are designed at the center of the precast wall panels to assure proper load-distribution from the walls to the foundation. Using a precast foundation greatly increases the speed of construction. All structural elements are field-bolted together. An interior wall track design allows engineered, prefabricated interior wall panels to roll into the home and "tip up" into place without wedging between the floor and ceiling.

7 Claims, 19 Drawing Sheets

(56) References Cited

U.S. PATENT DOCUMENTS 5,971,669 A * 10/1999 Crigler ..... E02D 29/0225 405/262
6,058,672 A * 5/2000 McClellan ..... E04B 1/04 52/592.1
6,233,891 B1 * 5/2001 De Cosse ..... E04C 2/2885 52/587.1
6,571,524 B2 * 6/2003 Pantelides ..... E04B 1/383 156/92
6,976,344 B2 * 12/2005 Sanger ..... E04B 1/04 52/270
7,147,197 B2 12/2006 Dalton
7,841,136 B2 * 11/2010 Czyznikiewicz ..... E04B 1/3444 52/64
8,132,388 B2 * 3/2012 Nagy ..... E04B 1/04 52/261
8,397,467 B2 * 3/2013 Krell ..... E04B 1/4107 52/745.11
8,490,363 B2 * 7/2013 Nagy ..... E04B 5/023 52/261
8,763,317 B2 * 7/2014 Krell ..... E04B 7/04 52/91.1
9,840,842 B2 * 12/2017 Hildebrand ..... E04B 2/94
10,047,776 B2 * 8/2018 Hettich ..... F16B 13/066
10,422,133 B2 * 9/2019 VanHoose ..... E04C 2/288
11,286,658 B2 * 3/2022 Morrow ..... E04B 5/023
11,598,084 B2 * 3/2023 Foley ..... E01C 11/02
2002/0033000 A1 * 3/2002 Pantelides ..... E04B 1/043 52/745.1
2004/0068945 A1 * 4/2004 Dalton ..... E04B 5/265 52/261
2007/0245637 A1 * 10/2007 Czyznikiewicz ..... E04B 1/3444 52/71
2010/0162651 A1 7/2010 Krell
2010/0162655 A1 7/2010 Krell
2010/0162658 A1 7/2010 Nagy et al.
2013/0061553 A1 3/2013 Nagy et al.
2016/0108948 A1 * 4/2016 Hettich ..... F16F 15/02 411/54
2016/0326764 A1 * 11/2016 Hildebrand ..... E04B 2/94
2017/0298627 A1 * 10/2017 VanHoose ..... E04C 2/46
2020/0354945 A1 * 11/2020 Morrow ..... E04B 1/24
2021/0148109 A1 * 5/2021 Foley ..... E04B 1/043
2021/0348377 A1 * 11/2021 Scott ..... E04B 5/43

* cited by examiner

CONCRETE PANEL RESIDENTIAL STRUCTURE SYSTEM AND METHOD

CROSS REFERENCE TO RELATED APPLICATIONS

This application claims the benefit of U.S. Provisional Application No. 63/178,268 filed Apr. 22, 2021.

FIELD OF THE INVENTION

The present invention relates to pre-cast concrete panel homes for rapid assembly and deployment and that can resist the effects of hurricanes and earthquakes, and to systems for installing walls in such homes.

BACKGROUND

Concrete homes are known in the prior art such as in U.S. Pat. Nos. 7,147,197 and 5,845,441. As shown in the '441 Patent, previous methods of connecting pre-cast concrete forms to construct a residence have resorted to welding. This requires the builder to be skilled in welding to construct a house. It is desirable to provide pre-cast concrete panels for a home that do not require welding of wall panels or roof panels.

It is desirable to provide a method for installing interior walls in houses that requires minimal time, effort and skill, but which provides a sturdy and durable wall.

SUMMARY OF THE INVENTION

Disclosed is a method of building residential structure in which the foundation, support walls and roof are comprised of precast concrete panels made at a manufacturing facility. The panels are all deliverable via a flatbed truck and sized to not require any oversize loads during transport to the house site. The panels are all attachable to adjacent panels via an attachment means, such as panel connection members comprising a straight coil loop embedded in the panel and having an opening to an outer surface of the panel, the straight coil loop being adapted to receive a threaded coil. Such a connection member facilitates connection to an abutting panel using common components and tools, such as a threaded nut, and may not necessarily require welding.

The only onsite concrete pouring occurs to pour the interior floor after the foundation "box" is erected, secured, and watertight. This method reduces the number of days of field construction and uses lower skilled assembly workers to erect on site. Further, the homes built using the present method are resistant to the environment (wind, rain, and flying debris).

Also disclosed is a track attachable to a ceiling and/or roof that allows for the quick and easy installation of interior walls within a pre-cast concrete home.

DETAILED DESCRIPTION

The disclosed method describes construction of two, three and four-bedroom one-story, precast concrete residences designed to resist great hurricane wind forces and moderate seismic forces in a manner that is quick and that can be in large part completed by unskilled labor. The entire residential structure, excluding the slab on grade, is comprised of plant-cast concrete panels made in a controlled manufacturing environment. Over the years, there have been many precast concrete houses built.

Figure 1B:
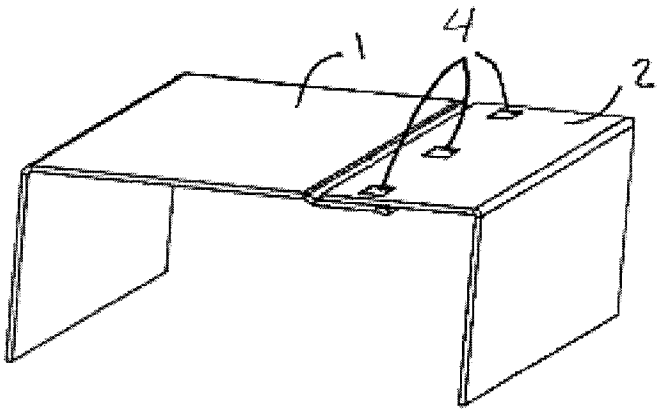
FIGS. 1*a* and 1*b* show first and second ceiling brackets with insertion and receiving members in detached and attached positions.
Figure 1A:
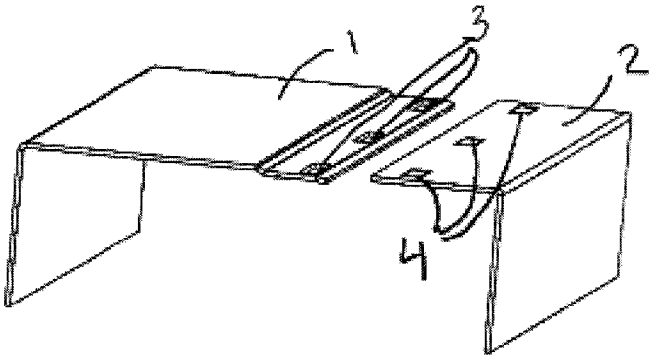

The disclosed method also describes installing interior wall panels using brackets halves at the bottom and top of the panels. FIGS. 1*a* and 1*b* show first 1 and second 2 ceiling brackets with insertion 3 and receiving 4 members in detached and attached positions.

Figure 2B:
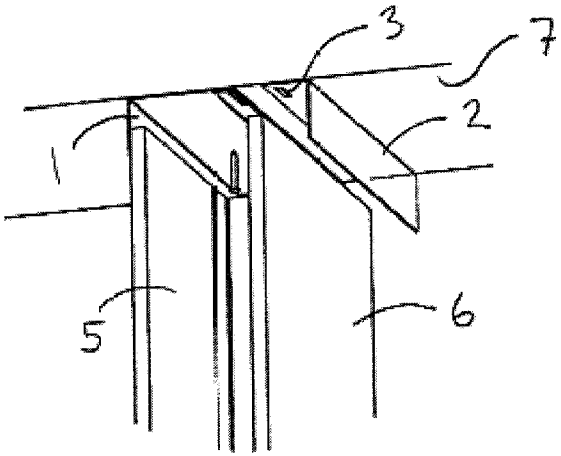
FIGS. 2*a* and 2*b* show the location on an interior wall near the ceiling where the first ceiling brackets having insertion members may be positioned to receive a second bracket with receiving members to hold an interior wall in place, before two brackets are connected together.
Figure 2A:
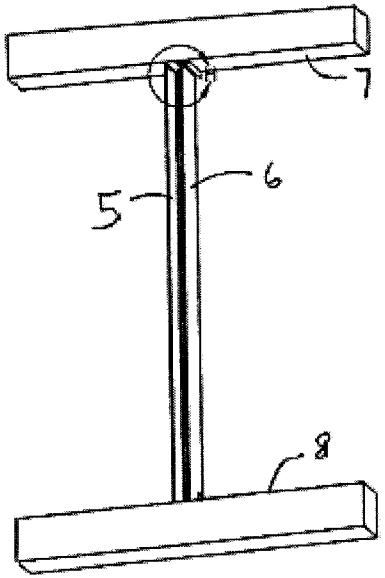

FIGS. 2*a* and 2*b* show the location on interior walls 5 and 6 near the ceiling 7 where the first ceiling brackets 1 having insertion members may be positioned to receive a second bracket 2 with receiving members 3 to hold an interior wall 6 in place, before bracket 2 has been moved to engage bracket 1. The lengths of brackets 1 and 2 may be about the same width as the wall panels 5, 6.

Figure 3B:
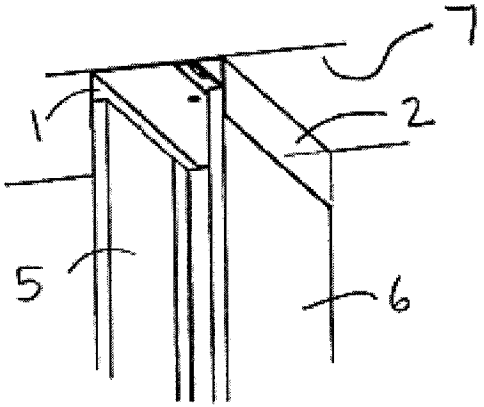
FIGS. 3*a* and 3*b* show the location on an interior wall near a ceiling where a first bracket having insertion members may be positioned to receive a second with receiving members to hold an interior wall in place, before the bracket members are connected together.
Figure 3A:
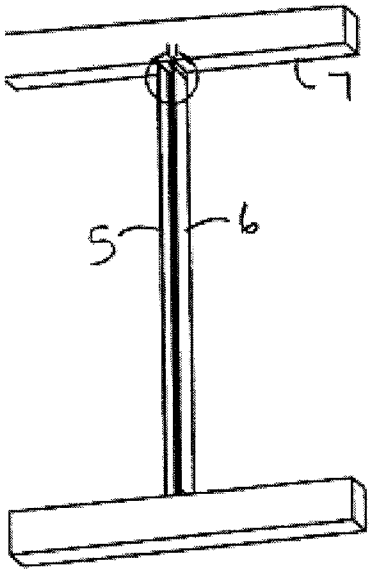

FIGS. 3*a* and 3*b* show the location on an interior wall 5, 6 near a ceiling 7 where a first bracket 1 having insertion members may be positioned to receive a second bracket 2 with receiving members to hold an interior wall 6 in place, after the brackets 1 and 2 are connected together.

Figure 4B:
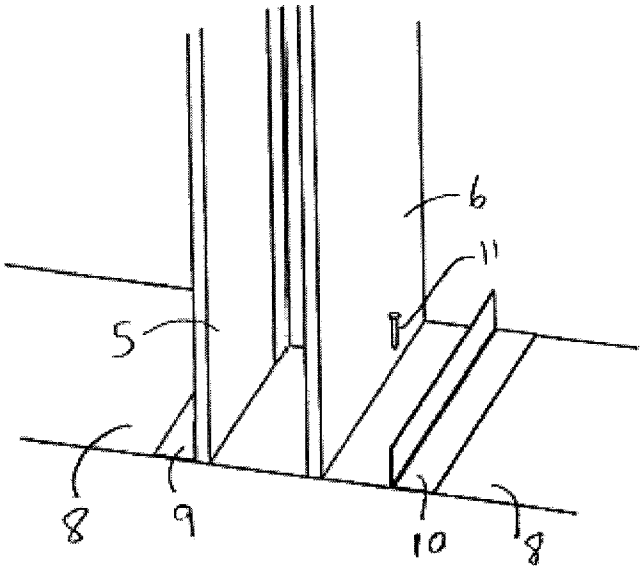
FIGS. 4*a* and 4*b* show the location on an interior wall near the floor where interior wall panels may be positioned and held in place, and where one the L brackets has not yet been moved to abut the wall panel and secured to the floor.
Figure 4A:
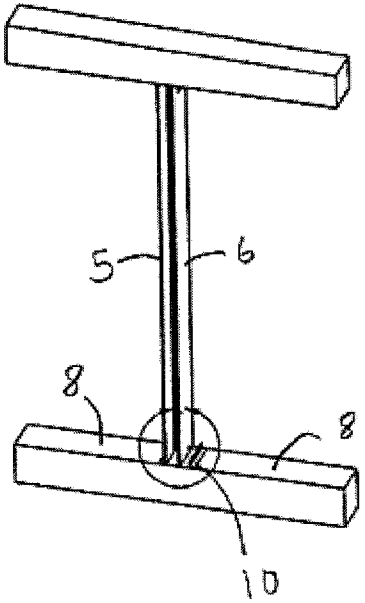

FIGS. 4*a* and 4*b* show the location on an interior wall 6 near the floor 8 where interior wall panel 6 may be positioned and held in place, and where L bracket 10 has not yet been moved to abut the wall panel 6 and secured to the floor 8.

Figure 5B:
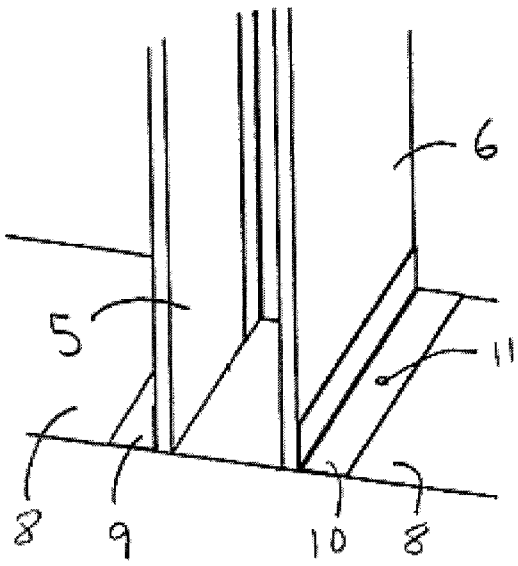
FIGS. 5*a* and 5*b* show the location on an interior wall near the floor where interior wall panels may be positioned and held in place, and where both L brackets have been secured to the floor to hold the wall panels in place.
Figure 5A:
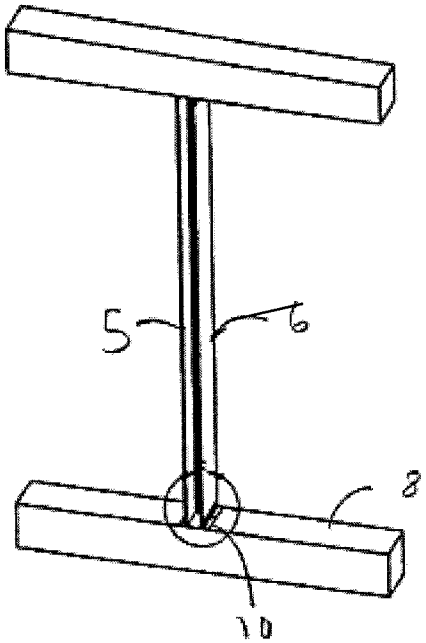

FIGS. 5*a* and 5*b* show the location on an interior wall 6 near the floor where interior wall panels may be positioned and held in place, and where both L brackets 9, 10 have been secured to the floor to hold the wall panels 5, 6 in place by screw or nail 11.

To affix a wall panel, L brackets 9, 10 may be affixed to a floor. Wall panel 5 may be lifted over the upwardly projecting edge. Then the first bracket 1 is placed against the top edge of the wall pane as shown in FIG. 1 and the bracket is secured to the ceiling or roof. Then second L bracket 10 is secured to the floor and the second wall panel is lifted over it so it abuts the interior of the upwardly projecting portion. Then the second bracket with receiving members is placed along the top edge of the wall bracket, and both moved toward the second bracket until the insertion members 3 of first bracket 1 snap into the receiving members 4 of second bracket 2 to old the wall panel in place. The distances between the insertion members3 may be evenly spaced to match the locations of the receiving members 4.

With regard to the structure itself, the foundation is formed by precast concrete panels. Typically, foundations are site cast using concrete trucks to deliver the material and crews to place the material in the excavation. With the disclosed design, the precast concrete foundation sections are delivered to the site and placed in the excavation. Foundation panel joints are designed at the center of the precast wall panels to assure proper load-distribution from the walls to the foundation. Using a precast foundation greatly increases the speed of construction.

Figure 7:
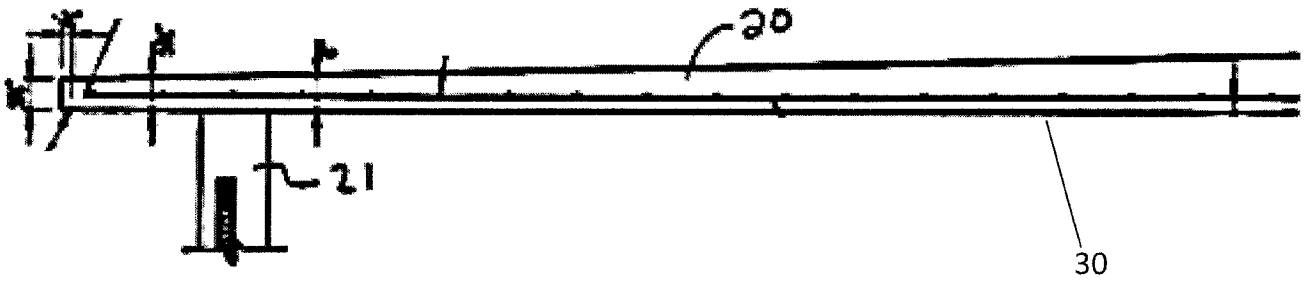
FIG. 7 shows a typical roof panel configuration.

As shown in FIG. 7, roof panel 20 may be held by exterior wall panel 21.

Figure 8:
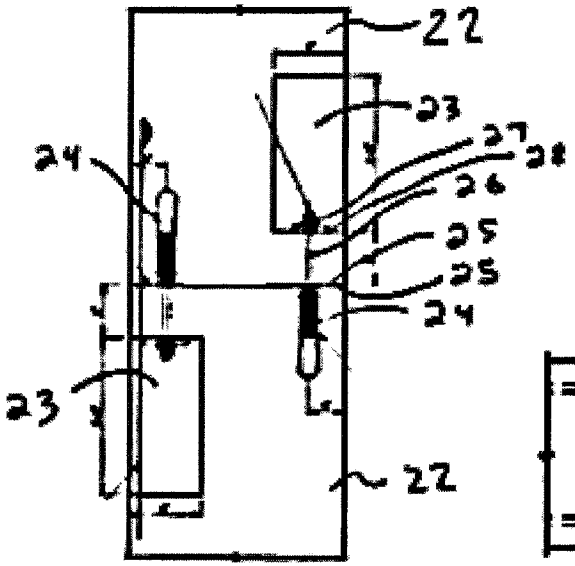
FIG. 8 shows top cut-away view of connection members for foundation panels.

As shown in FIG. 8 foundation panels 22 have a cavity 23 and an embedded threaded coil 24 embedded in the concrete and which is exposed to an edge 25 that abuts adjacent blocks 22. To secure adjacent panels to each other, the panels are aligned edge to edge. Threaded bolt is inserted into cavity 23 then extend through a hole 28 extending from the cavity to the edge, then threaded into the threaded coil 24 of the abutting panel 22. The threaded bolt is then secured to the panel by washer 28 and 27. Similar structures are used to secure other abutting panels to each other. This methodology may be performed by unskilled labor, which make the present design especially suitable for use in locations were disaster has struck and an insurrection number of construction workers are available to construed more sophisticated structures.

Figure 10:
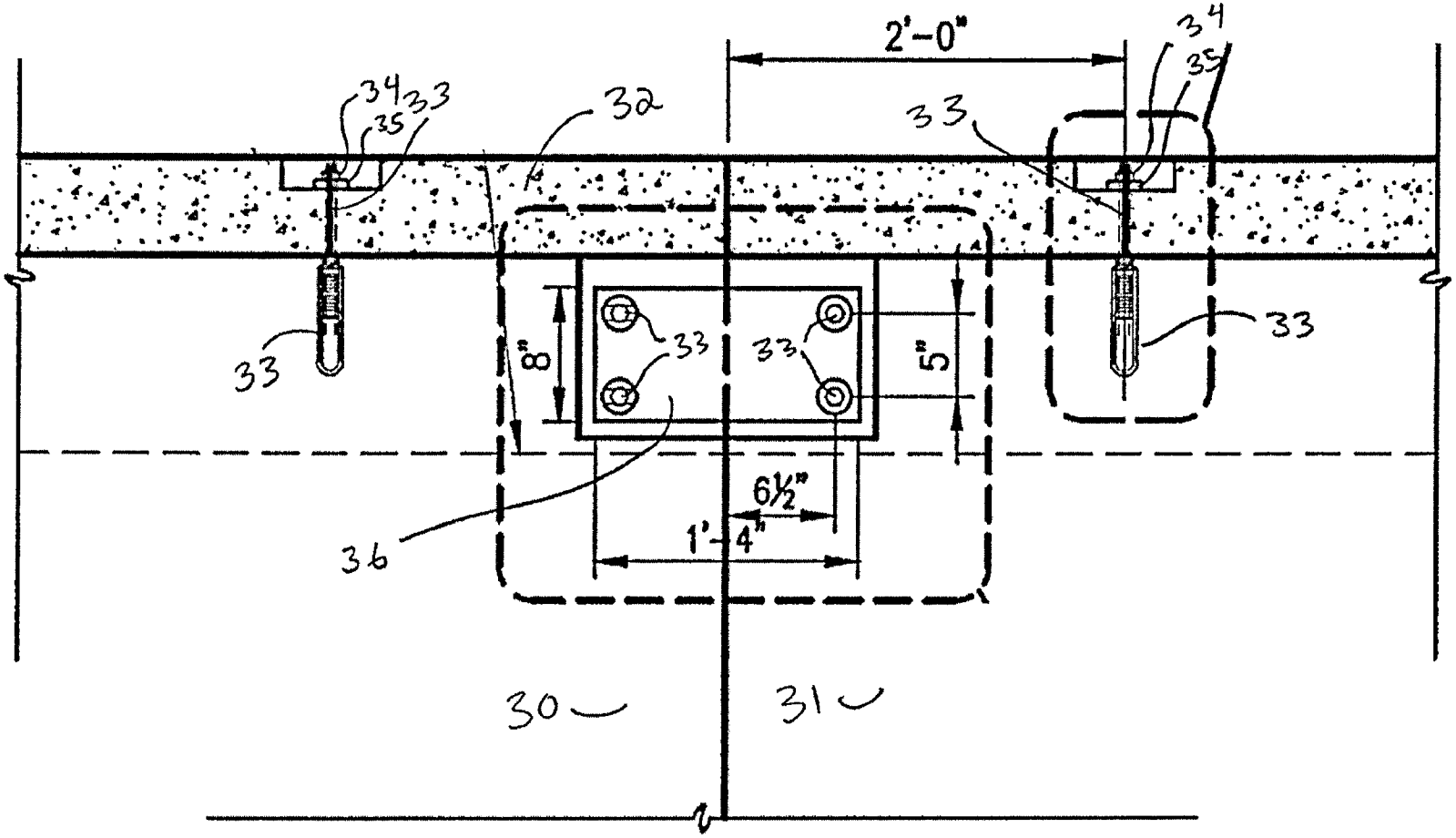
FIG. 10 shows an inside cut-away view of connection members for the tops of two abutting wall panels and their connections to roof panels.
Figure 11:
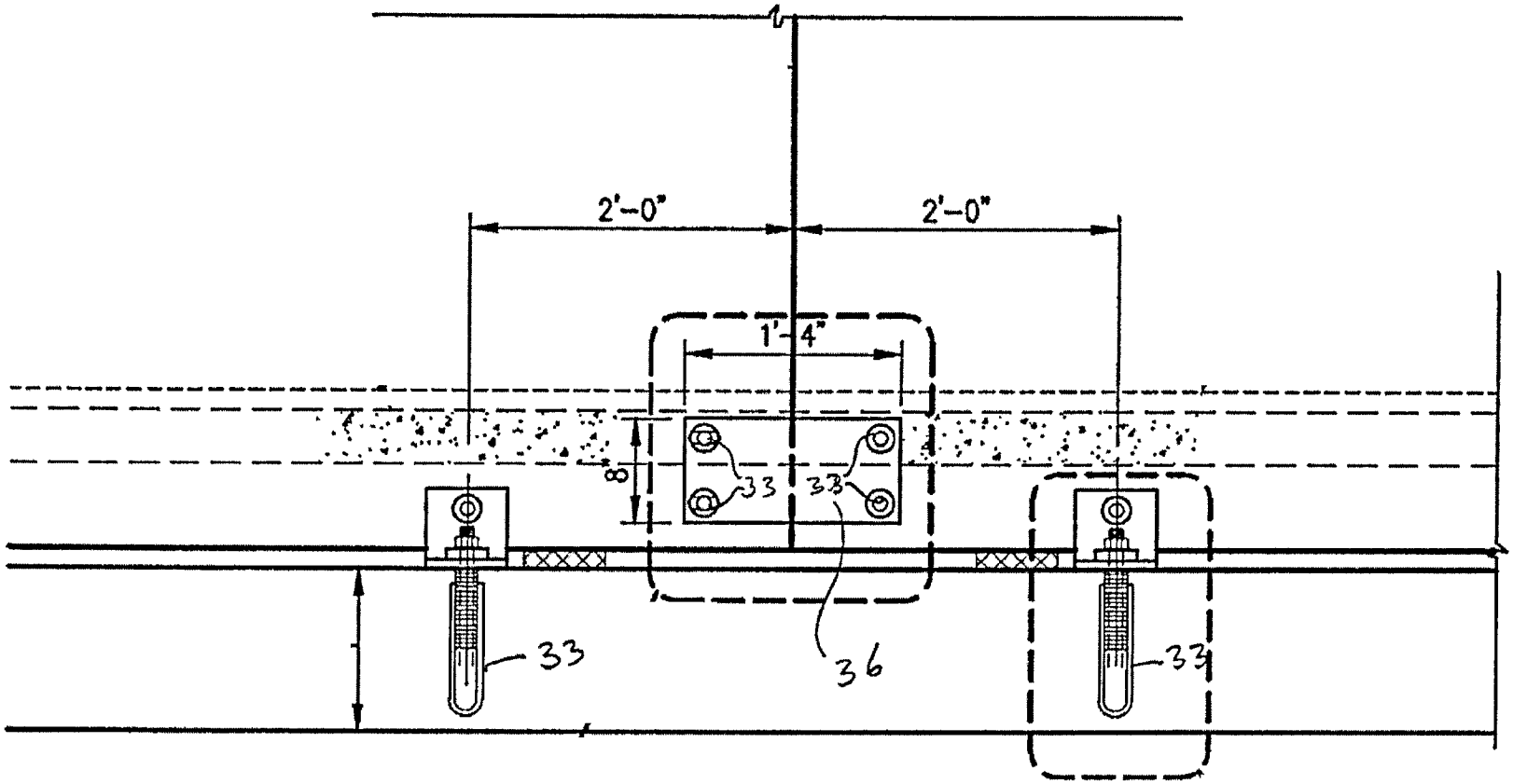
FIG. 11 shows an inside cut-away view of connection members for the bottoms of two abutting wall panels and their connections to foundation panels.
Figure 12:
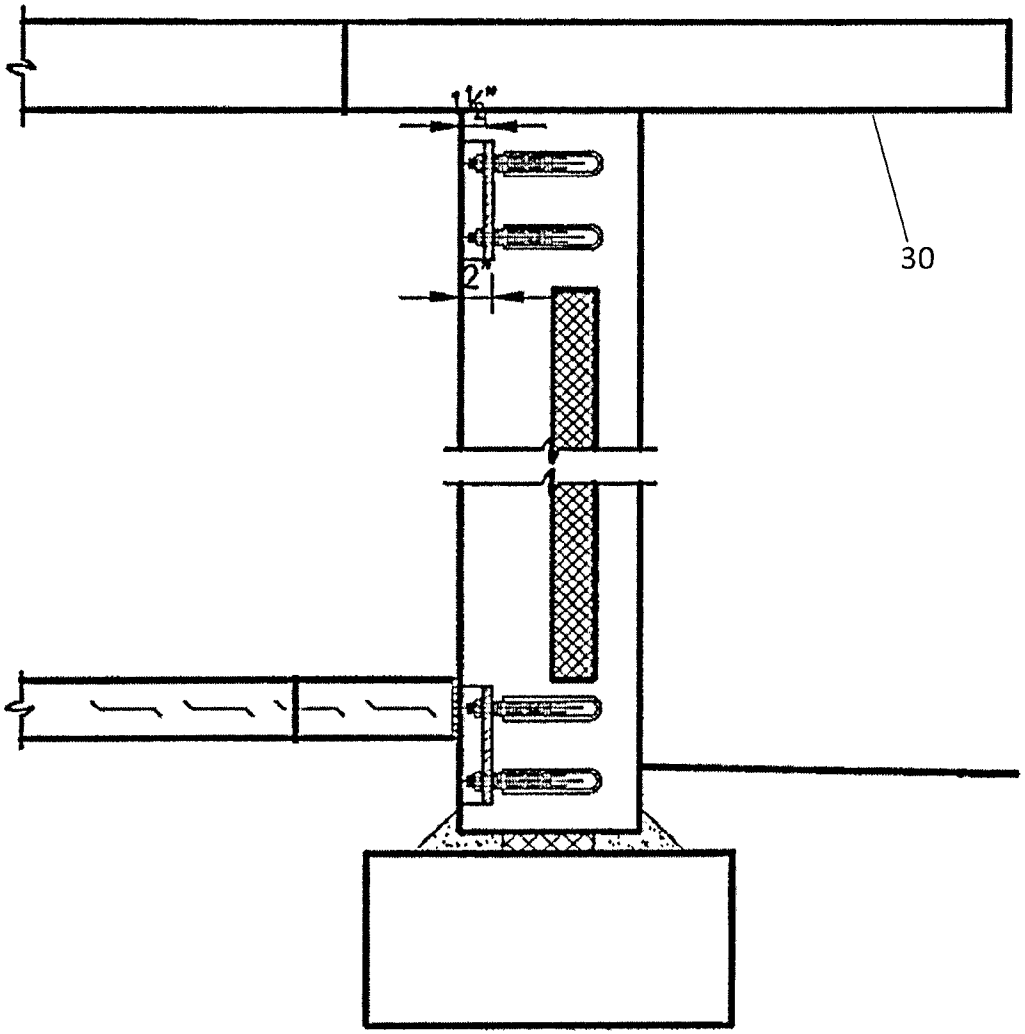
FIG. 12 shows a side cross section view of a side panel showing connection members with a plate used for connection to an abutting side panel.
Figure 13:
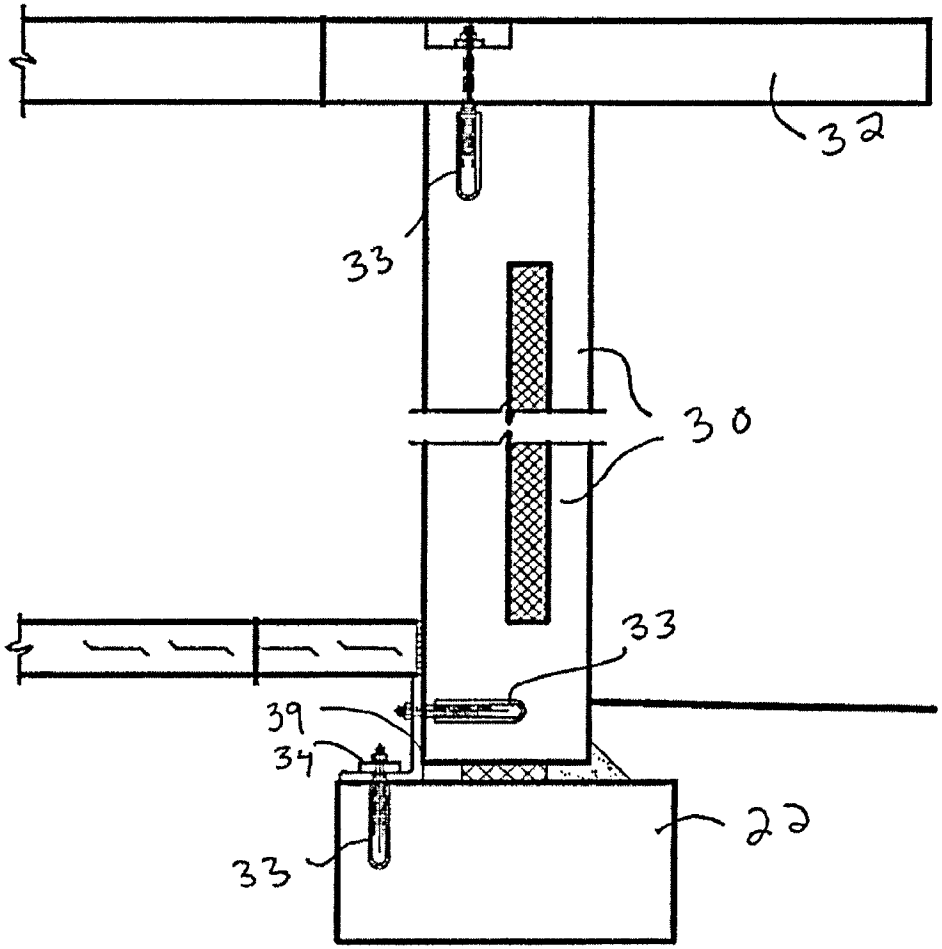
FIG. 13 shows a side cross section view of a side panel showing connection members for connection to an abutting roof panel and a foundation panel.

As shown in FIG. 10 shows an inside cut-away view of connection members for the tops of two abutting wall panels 30, 31 and their connections to a roof panel 32. Threaded coils 33 are embed in the concrete of panels 30 and 31 and secure to roof pane 32 by threaded bolts 33, nuts 34 and washers 35, similarly as described above. Further securement of adjacent wall panels is provided by metal plate 36 which is secured by threaded bolts 33 to threaded coils embedded in the wall panel. The same type of hardware is used to secure the bottoms of adjacent walls to foundation panels as shown in FIG. 11. A side view cross section view of a side panel showing connection members with a plate used for connection to an abutting side panel is shown in FIG. 12. FIG. 13 shows a side cross section view of a side panel showing connection members for connection to an abutting roof panel 32 and a foundation panel 22, A steel L bracket 39 facilitates connection between the foundation panel 22 and wall panel 30, as shown in greater detail in FIG. 14.

Figure 14:
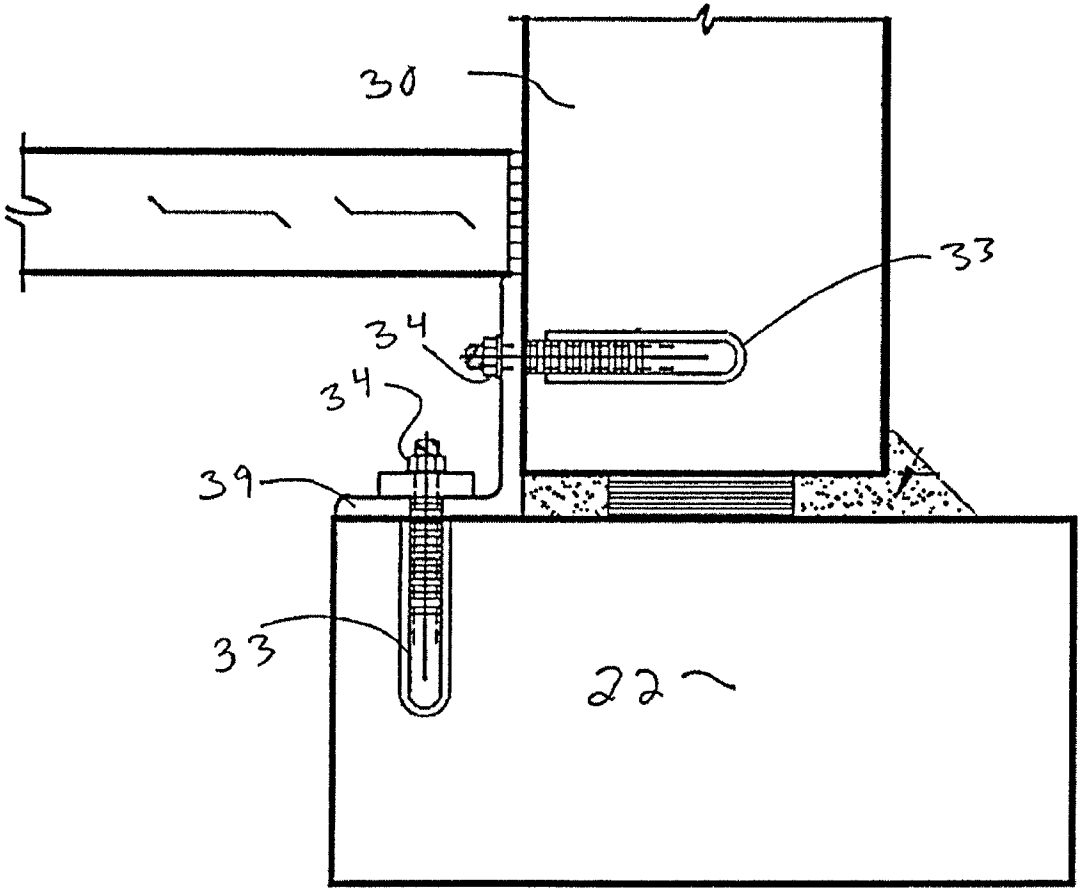
FIG. 14 shows a side cross section view of a side panel showing connection members for connection to a foundation panel include an L-bracket.

FIG. 14 shows a side cross section view of a side panel 30 showing connection members for connection to a foundation panel 22 include an L-bracket 39.

Figure 15:
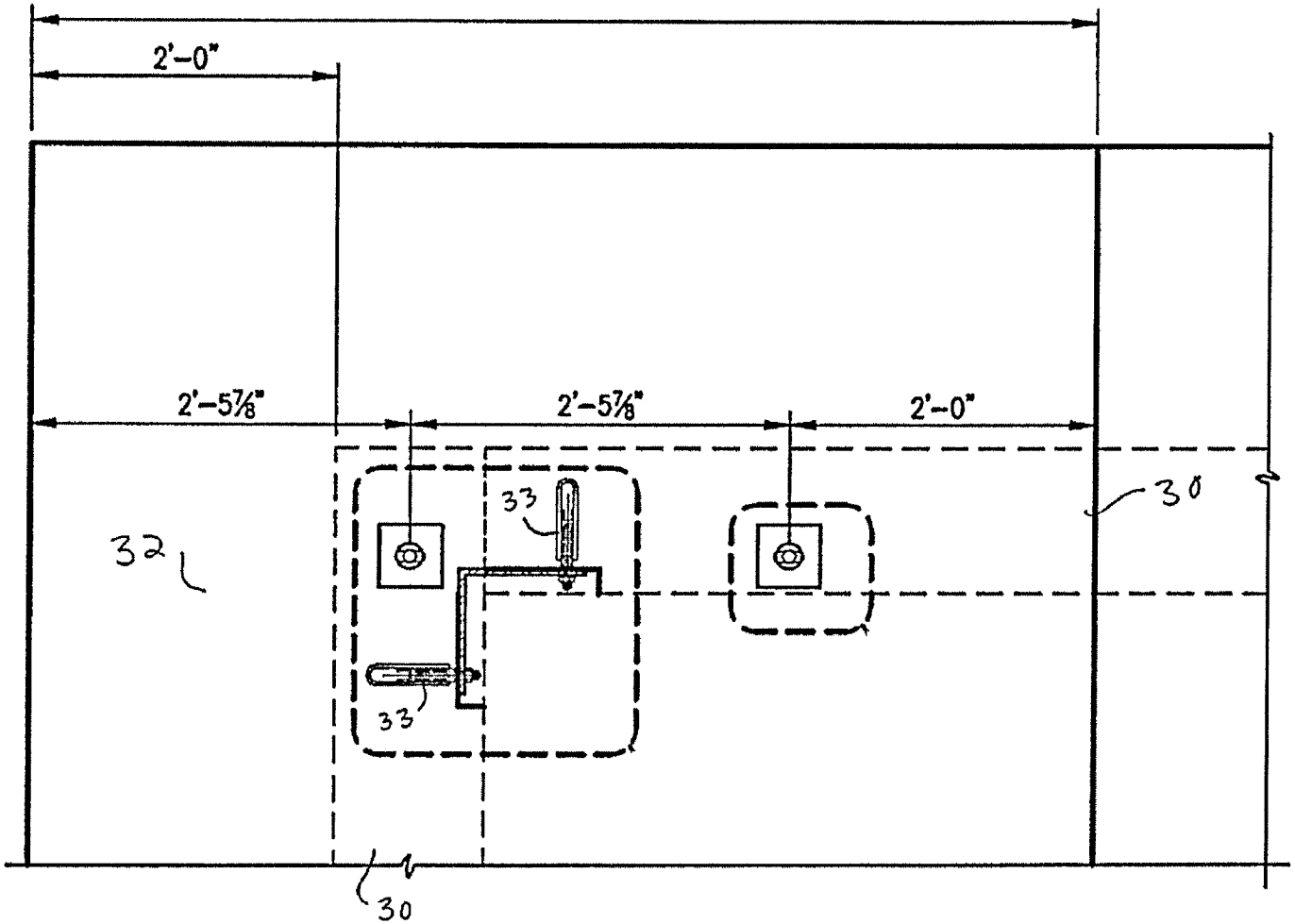
FIG. 15 shows a top cross section view of the corner of a roof panel showing connection members for connection to the tops of side walls at a wall corner.

FIG. 15 shows a top cross section view of the corner of a roof panel 32 showing connection members for connection to the tops of side walls 30 at a wall corner. Again, embedded coils 33 receive threaded shafts to secure the components.

Figure 16A:
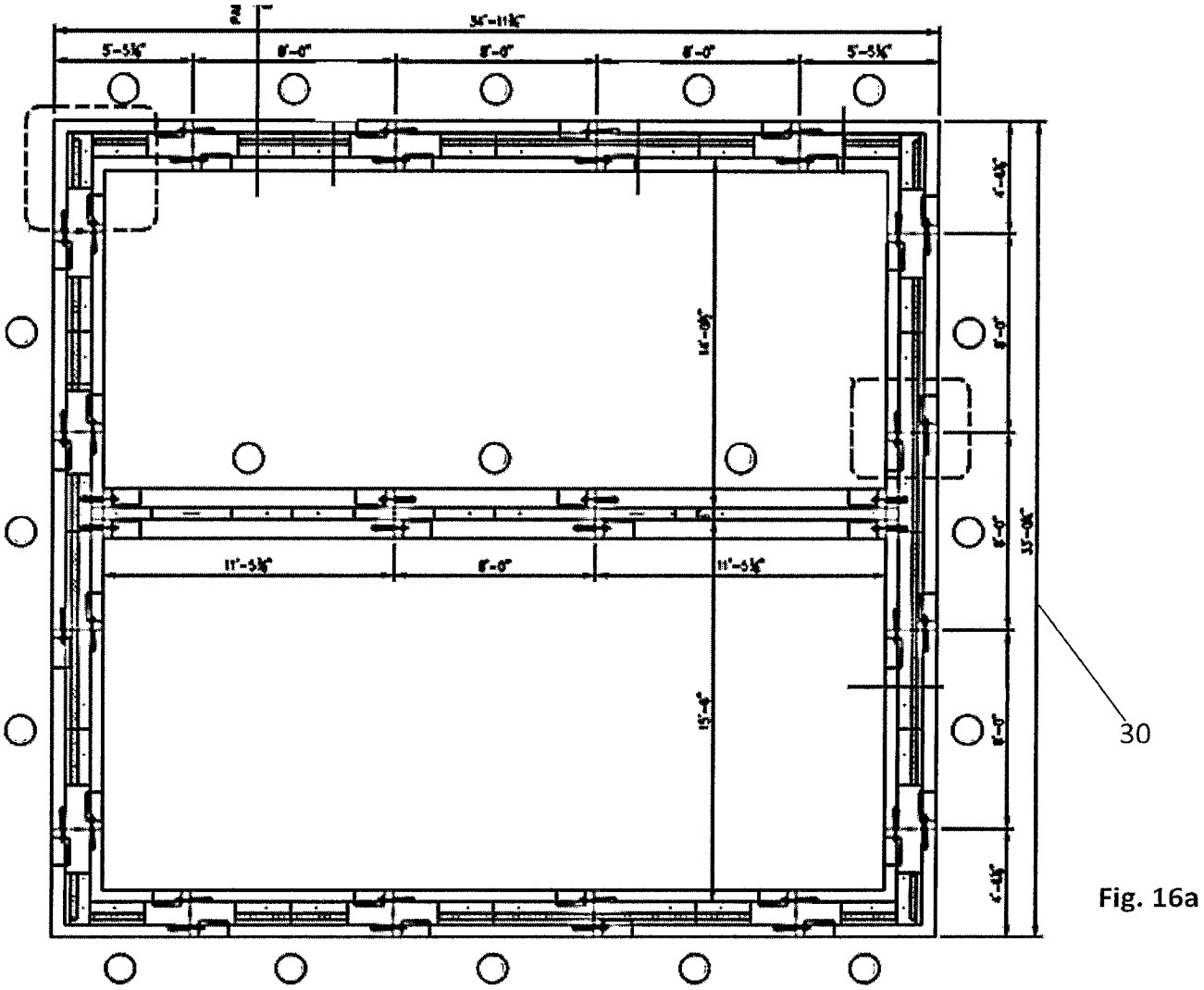
FIGS. 16*a* and 16*b* show foundation and floor plans for a two-bedroom house in accordance with the invention.
Figure 16B:
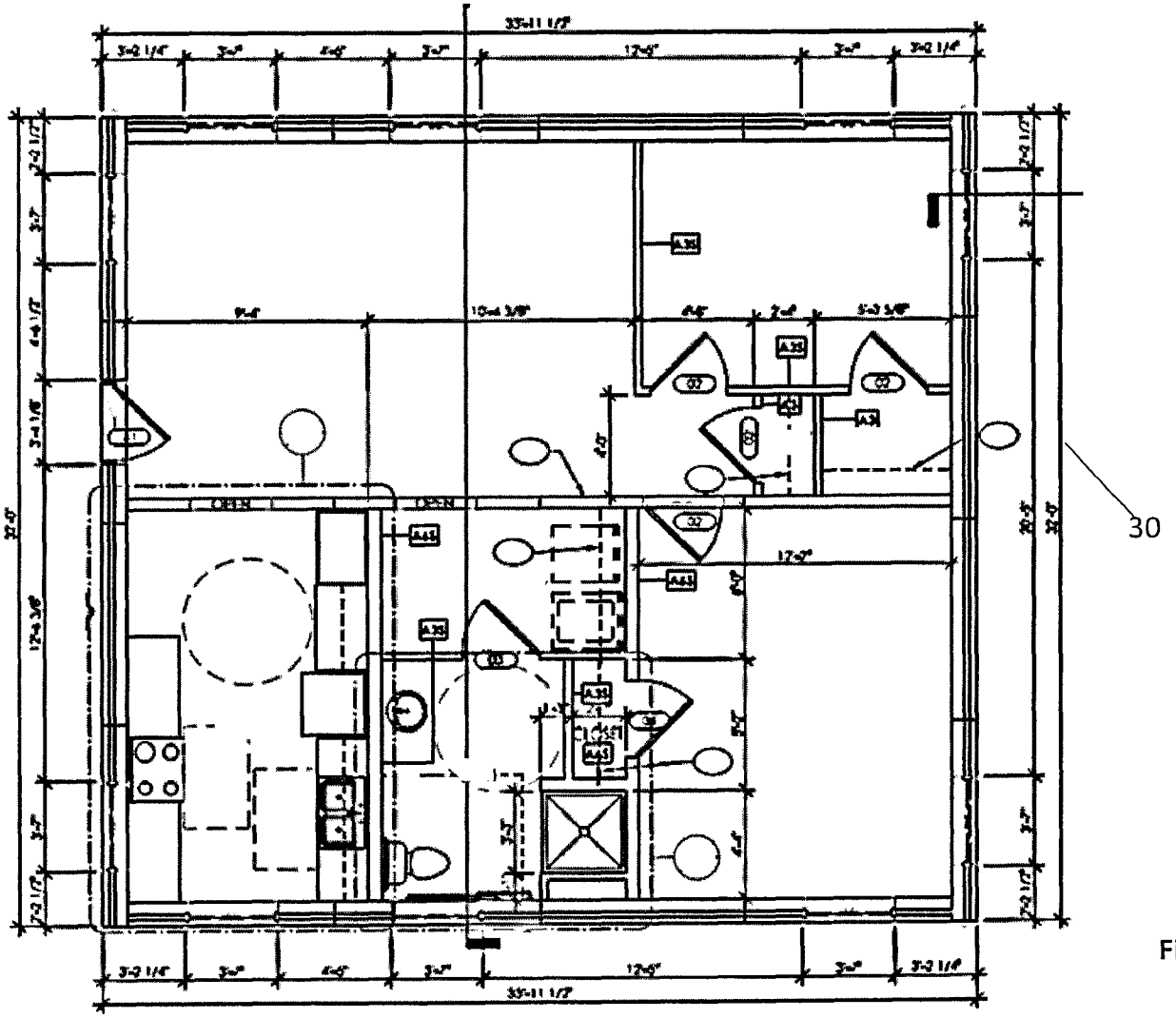
Figure 17A:
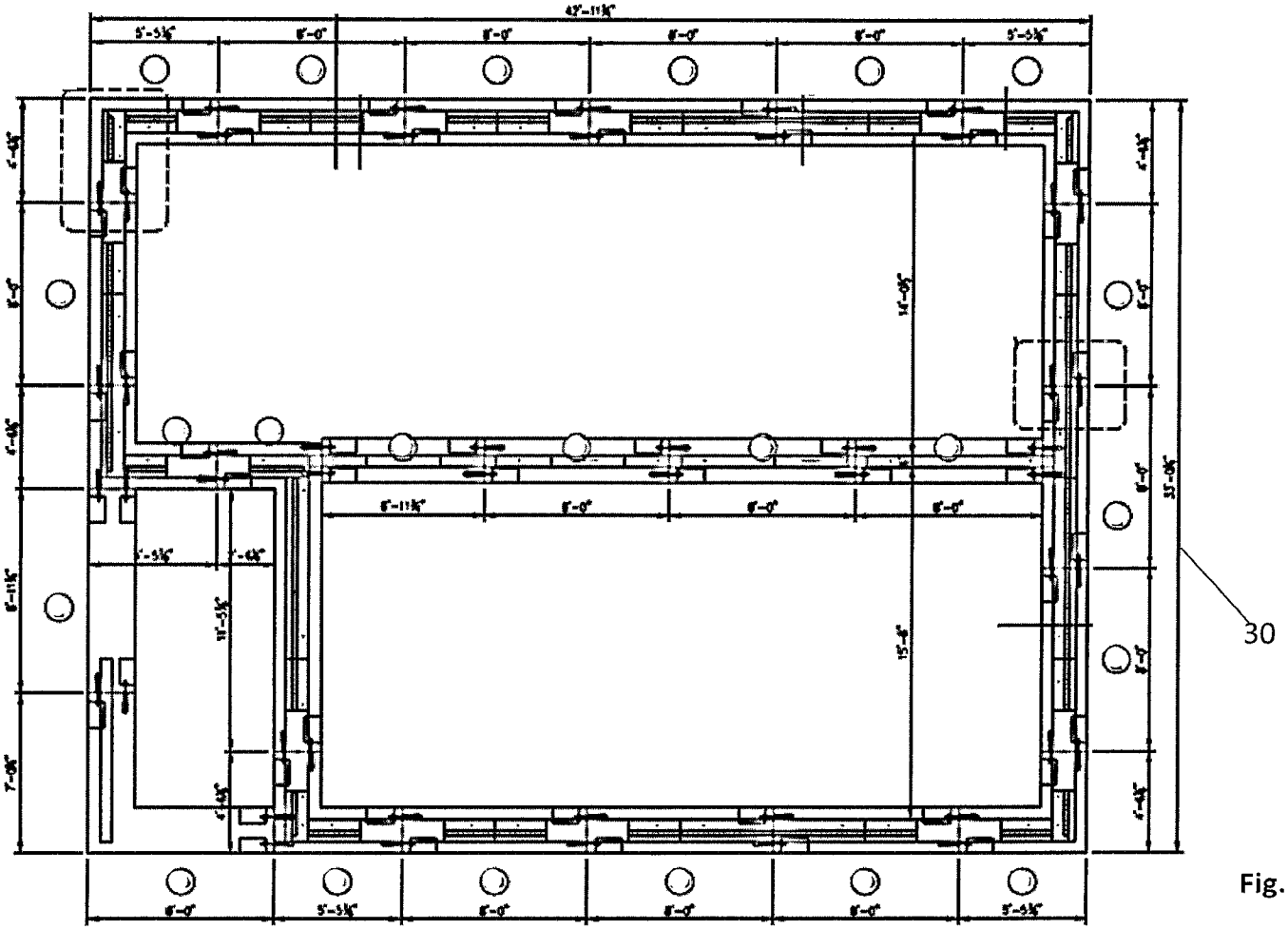
FIGS. 17*a* and 17*b* show foundation and floor plans for a three-bedroom house in accordance with the invention.
Figure 17B:
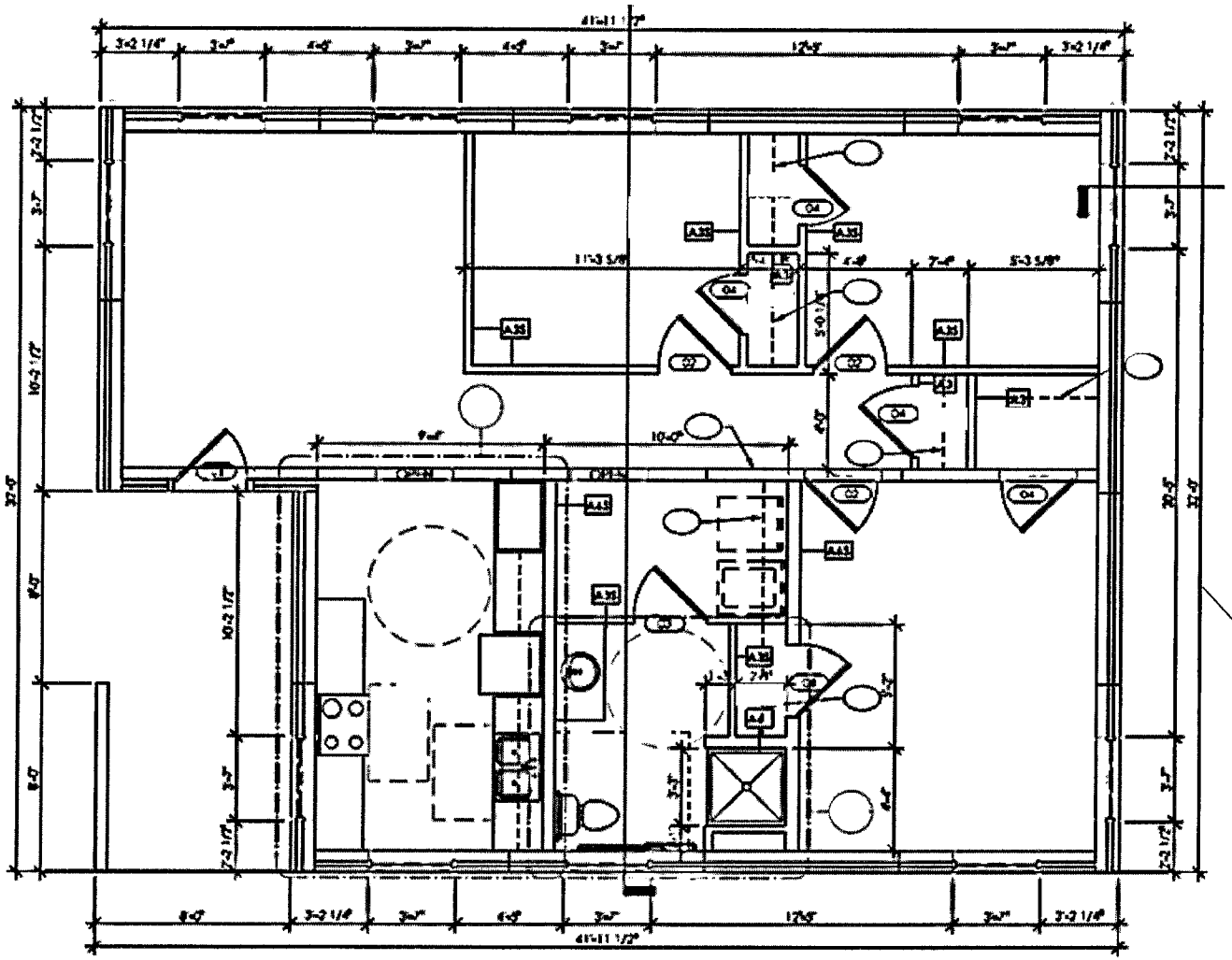
Figure 18A:
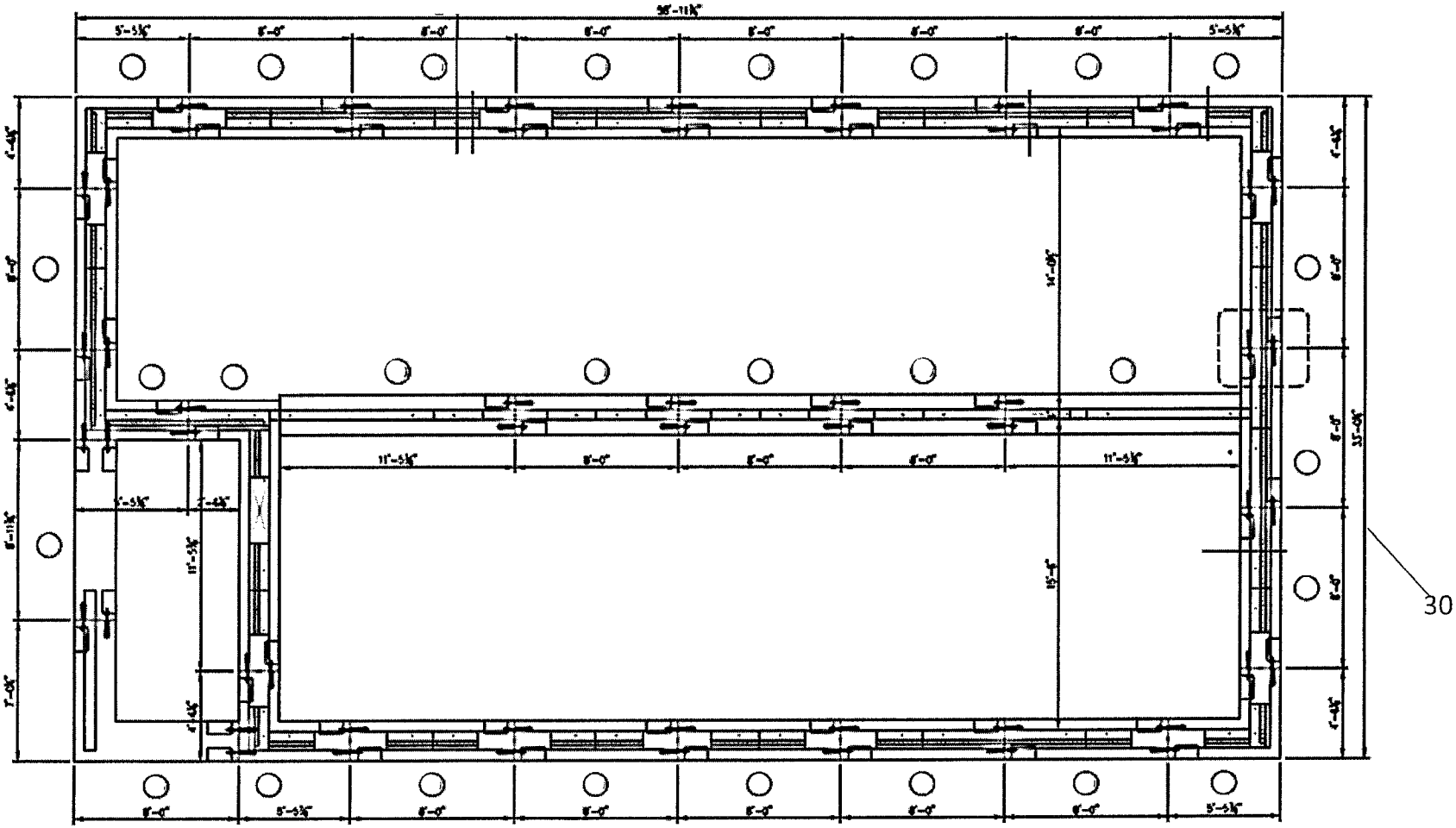
FIGS. 18*a* and 18*b* show foundation and floor plans for a four-bedroom house in accordance with the invention.
Figure 18B:
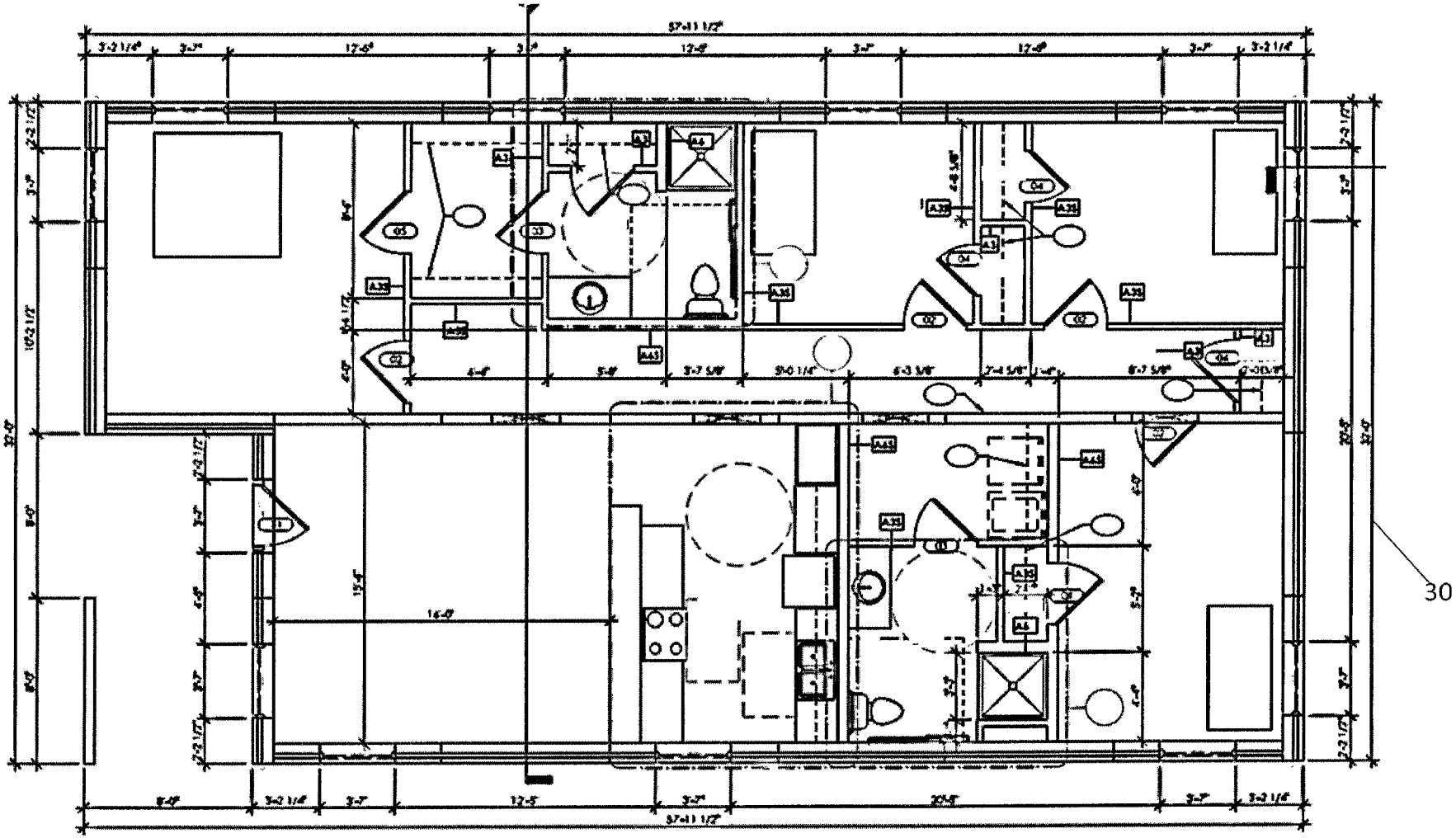

FIGS. 16*a* and 16*b* show foundation and floor plans respectively for a two-bedroom house in accordance with the invention. FIGS. 17*a* and 17*b* show foundation and floor plans for a three-bedroom house in accordance with the invention. FIGS. 18*a* and 18*b* show foundation and floor plans for a four-bedroom house in accordance with the invention.

All structural elements are field-bolted together. Using unskilled labor, the pieces are merely erected (set into place) and bolted to each other. This includes the precast foundations. There is no welding of connection plates resulting in a simple to erect structure.

All of the foundation and wall panel lengths are limited to a maximum width and length of eight feet. This provides for easy transportation to the site and easy placement with a small crane. The roof panels have a maximum width of eight feet. This allows for easy transportation through limited-access areas and roads. While longer and weighing more, the roof panels can easily be set with a small crane.

Once erected and bolted together, the precast structure provides an exceptionally stable and resilient structure resistant to very high lateral forces produced by wind and earthquakes. Compared to standard, wood-framed residence construction, precast concrete construction also greatly enhances fire-resistance and acoustical properties.

In most wind or seismic events, failure occurs in the components (i.e. siding, roofing, etc.) of the residence. The disclosed design incorporates the residence exterior finishes into the structural components. Thus, eliminating, or lessening, component failure.

The disclosed design permits speedy construction. With all precast structural components, the foundations, roof panels and wall panels can be set within days to provide a completed structure. Prepackaged electrical wiring and prepackaged plumbing piping can be installed in a matter of days. The slab on grade, cast inside of the residence, can be accomplished in hours. Once the slab has cured, typically in three days, prefabricated interior walls can be set and connected together. This leaves only final finishes. Packaged cabinet systems and plumbing fixtures can be installed in a matter of days. It is anticipated that the entire residence can be completed within one month assuming that the contractor has prepared the site properly.

1.1 Builder Responsibility. The intent is to provide home contractors (builders) with construction documents and all components required to construct a complete residence. These include, but are not limited to:

a. All precast concrete elements and connection materials.

b. All interior walls and connection materials.

c. All cabinetry and accessories.

d. All mechanical, electrical, plumbing components and accessories.

e. Documentation for installation and assembly

It is the Builder's responsibility to erect, install and finish these components in compliance with the supplied instructions and all relevant building codes.

It is the contractor's responsibility to provide:

a. A construction site meeting the requirements of the construction documents.

b. Submittals for permitting and obtaining permits c. Architectural, and if required, engineering certification of the construction documents for permitting. This is typically done through a local architect and engineer and is project site specific.

2.0 Structural Design Standards. Structural analysis and design are based on:

a. International Code Council's ICC 500-2014 (ICC), ICC/NSSA Standard for the Design and Construction of Storm Shelters.

b. International Building Code (IBC) 2018.

c. American Society of Civil Engineers (ASCE), ASCE 7-16.

d. American Concrete Institute (ACI), ACI 318-14.

e. Precast Concrete Institute (PCI), MNL-120-17.

2.1 ICC 500 Structural Compliance. ICC 500 is a referenced document in the IBC. In setting minimum standards for tornado and hurricane shelters, the goal of the precast structure design is to comply with minimum tornado and hurricane forces to provide shelter during these events. Compliance with requirements, other than structure, are not addressed in the design of the residences.

Minimum requirements included in the structural design of the residences are:

a. Per ICC Section 107, information for the design is as follows:

i. The type of shelter is a residential combination tornado and hurricane shelter.

ii. Shelter Design Wind Speed is 220 mph. This is an ultimate (strength design) wind speed.

1. Hurricane: Design wind speed of 220 mph.

a. This includes all of the coastal areas of the United States and Puerto Rico. In most areas, the design wind speed is less.

2. Tornado: Design wind speed of 200 mph.

a. This includes the Central Atlantic Coast and the Gulf Coast.

iii. Wind Exposure Category=D, flat, unobstructed areas and water surface.

iv. Topography factor, Kzt=1.46, using 2D-ridge, 50 feet high hill and 200 feet upwind distance.

v. Directionality factor=0.85.

vi. Flooding was not taken into account.

vii. Pressure and missile impact requirements have been complied with.

viii. Maximum occupant load=15 persons.

ix. Useable storm shelter floor area:

1. Two Bedroom: +/−961 sf.

2. Three Bedroom: +/−1073 sf.

3. Four Bedroom: +/−1554 sf.

x. Foundation Bearing Capacity: 1,500 psf minimum allowable soil bearing.

xi. Rainfall Rate: 5 inches per hour, 100-Year.

1. This includes all of the coastal areas of the United States and Puerto Rico.

2.2 IBC Structural Compliance. Not part of ICC, the minimum requirements included in the structural design of the residences are a. Seismic: Minimum spectral response design for $S_{DS}$=0.800.

i. This moderately-high seismic loading includes all of the coastal areas of the United States and Puerto Rico. In most areas, the design seismic forces will be less.

b. Roof Live Load: 20 pounds per square foot (psf).

i. This includes all of the coastal areas of the United States and Puerto Rico. In most areas, the design roof live load is less.

c. Relative to the wind speed, ICC minimum speed is 220 mph as stated above. However, IBC wind speed is 170 mph for Florida and Puerto Rico. As stated, 220 mph was used to comply with ICC.

2.3 Basic Structural System. The basic structural system is:

a. Gravity Loading: Precast concrete roof panels bearing on precast concrete wall panels supported by precast concrete foundations. Precast concrete foundations are bearing on soil.

b. Lateral Loading: Wind and seismic loading is resisted by shear walls. The shear walls are the precast concrete walls panels supported by the precast concrete foundations. The precast concrete roof panels act as a rigid diaphragm. Interior, non-concrete walls are not part of the lateral-load-resisting system.

The basic materials are:

a. Precast Concrete: 4,000 psi Minimum 28-day compressive strength.

b. Reinforcing: ASTM A615, Grade 60, Fy=60 ksi.

c. Structural Steel: Plate, ASTM A36, Fy=36 ksi.

d. Bolts: Design basis using Dayton Superior data.

3.0 Precast Components. Foundation, wall and roof panels are cast using normal-weight concrete in a plant setting. These are typically termed "Precast" or "Precast Panels".

3.1 Roof Panels. The precast roof panels are reinforced, solid concrete panels designed to span from exterior walls to interior wall. The roof panels support the roofing and required live load (typically 20 psf) in transferring the load to the wall panels. In addition, the panels act as a diaphragm for transferring wind and seismic forces to the wall panels.

The top of the panel has an approximate ¼" per foot slope, from the ridge line to the overhang, for drainage of water. Insulation and roofing material are placed on the top surface of the panels. The typical roof panel configuration is shown in FIG. 7 and described as follows:

a. Interior Bearing Thickness: +/−10 inches.

b. Bearing at Inside Face of Wall Panel: 6 inches.

3.2 Wall Panels. The precast wall panels are reinforced, sandwich panels designed to span from the roof panel to the foundation panel. The wall panels are load-bearing with the roof panels setting on top. These panels support the weight of the roof panels, roofing materials and required roof live load (typically 20 psf). In addition, the wall panels act as lateral-load-resisting system (shear walls) in transferring the wind and seismic loads to the foundation.

Due to varying thermal requirements throughout the United States and its territories, two panel configurations are given. The typical wall panel configuration is as follows:

a. Cold Climate:

i. 6" Inner wythe.

ii. 2 ¾" Polyisocyanurate (polyiso) insulation.

iii. 3" Outer wythe.

b. Warm Climate:

i. 6" Inner wythe.

ii. 1" Expanded polystyrene (XPS) insulation.

iii. 3" Outer wythe.

3.3 Foundation Panels. The precast foundation panels are reinforced, solid panels typically plant-cast in 8-foot long sections. Connections from the wall panels, transfer wind and seismic forces into the foundation panels (which act as one continuous system), which is then supported by the soil.

Figure 9:
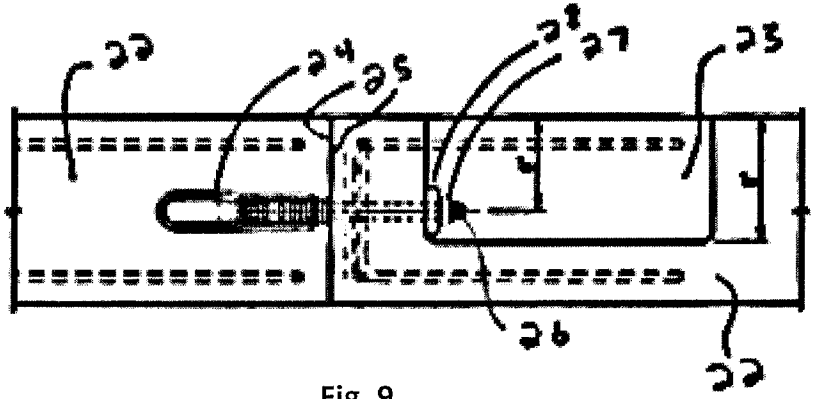
FIG. 9 shows a side cut-away view of a connection member for foundation panels.

The typical thickness is 12 inches and the typical width is 24 inches. FIGS. 8 and 9 show connection members for foundation panels. Each panel connection member comprises a straight coil loop embedded in a panel and having an opening to an outer surface of the panel, the straight coil loop being adapted to receive a threaded coil. A threaded nut may be applied to the threaded coil to bolt adjacent panels together.

3.4 Hardware. Steel connection components, or hardware, are fabricated and placed into the precast panel forms before casting the concrete. This hardware is then connected to during erection. Dayton Superior, an international precast hardware manufacturer and supplier, has been used as the Basis of Design for all hardware connections.

4.0 Precast Panel Fabrication. The structural components consist of foundations, roof panels and wall panels. All of the structural components are precast, non-prestressed concrete. Standardized casting beds are used to cast all of the components, either, in a factory-setting or on-site. Connection hardware such as straight coil loops are embedded in a panel and have openings to an outer surface of the panel and are set in the bed and secured to the bed formwork as shown in FIGS. 8 and 9. The straight coil loops are adapted to receive a threaded coil or bolt. Mild reinforcing, setting on bolsters or chairs, is then placed within the bed and tied. Lifting hardware is also secured to the reinforcing.

The concrete is then placed into the formwork. Vibrators are used to consolidate the concrete around the reinforcing and hardware.

Curing of the concrete, within the bed, will take place for about three days. Once the concrete strength reaches 2,800 psi (70% $f'_c$), a small crane will lift the partially cured panel from the bed for transportation or field erection.

All concrete is normal-weight (145 pcf) concrete containing various admixtures with mild steel reinforcing.

Door and window frames are set into the formwork. This alleviates the need for field installation of the frames.

Outer-Wythe Concrete (Exterior): The wall and roof panels will be form-facing for as-cast finishes. Concrete surface irregularities tolerance will comply with Surface Finish-2.0: ACI 117 (ACI 117M) Class B, ¼ inch (6 mm). Maximum thickness will be 3 inches. Form liners will be used to create patterns on the outside face of the concrete to meet architectural requirements.

Insulation for Warm Climates: Molded-Polystyrene Board Insulation: ASTM C578, Type I, 0.90 lb/cu. ft. (15 kg/cu·m); square edges; with minimum thickness of 1 inch.

Insulation for Cold Climates: Polyisocyanurate Board Insulation: ASTM C591, Type II, 2.5 lb/cu. ft. (40 kg/cu·m) unfaced, with minimum thickness of 2¾ inches.

Inner-Wythe Concrete (Interior): The wall and roof panels will have a hard-troweled, smooth finish suitable for painting. Minimum thickness will be 4 inches, although, 6 inches will be common in most areas.

5.0 Architectural Design. Architectural design is based on affordable housing concerns. The design is essentially a box with a flat or slightly slanted roof. However, as stated above, architectural accents will be cast into the wall panels. The design reflects a modern architecture aesthetic with clean lines while embracing a minimalist approach.

The exterior wall panels may be painted per the customer's requirements. Due to the flat roof, no choice of color needs to be made.

5.1 Sustainability

LEED (Leadership in Energy and Environmental Design) is not addressed in the design. However, many aspects of the design comply with LEED requirements. Concrete and steel reinforcing are both recycled materials. The entire exterior of the residence comprises these materials. The following material specifications, complying with LEED requirements, are used in the design.

The manufacturing of the precast concrete will use regional materials: Concrete should be manufactured within 500 miles (800 km) of Project site from aggregates and cementitious materials that have been extracted, or recovered, as well as manufactured, within 500 miles (800 km) of Project site.

Reinforcing steel recycled content of steel products should have postconsumer recycled content plus one-half of pre-consumer recycled content not less than 60 percent.

5.2 Residence Environmental Properties

The following items enhance the overall experience of the residence:

a. Precast Concrete Sandwich Panels:
   i. Acoustic Properties: Sound Transmission Class (STC)=58, Grade 1 Suburban, upper bound=61, lower bound=56. This provides excellent acoustic properties for minimizing the noise level within the residence.
   ii. Fire Resistance: At least 3 hours for the walls and roof panels. This is much higher than standard, stud-built residences.
   iii. Thermal Resistance:
      1. Cold Climates: Walls minimum R=20, Roof minimum R=30.
      2. Warm Climates: Walls minimum R=12, Roof minimum R=20.

6.0 Site Preparation. Prepared by the contractor, the site must be relatively level with small crane access provided around the house footprint. A prepared surface for crane setup must also be provided to assure crane stability during lifting and erection of the panels.

6.1 Foundation Excavation. Prepared by the contractor, all foundation excavations must be complete. The bottom of the foundation excavation (i.e. soil) must be level to within ¼ inch in ten feet everywhere within the excavation. Levelness of the bottom of the foundation excavation is critical to the success of the overall structure. The foundation width must be over-excavated to allow for access to panel-to-foundation connections on the inside of the structure.

6.2 Slab on Grade Preparation. Prepared by the contractor, the bearing for the slab on grade must be properly achieved. The following specifications must be achieved for adequate bearing of the slab on grade:

a. Sub-Base (Drainage Course): This is the aggregate layer directly below the vapor retarder.
   i. Narrowly graded mixture of washed crushed stone, or crushed or uncrushed gravel; ASTM D448; coarse-aggregate grading Size 57; with 100 percent passing a 1½-inch (37.5-mm) sieve and zero to 5 percent passing a No. 8 (2.36-mm) sieve.
   ii. Compact aggregate materials to not less than 95 percent of maximum dry unit weight according to ASTM D1557.

b. Sub-Grade: This layer is directly below the sub-base. It is the uppermost surface of an excavation or the top surface of a fill or backfill immediately below sub-base. This is typically soil.
   i. Satisfactory Soils: Soil Classification Groups GW, GP, GM, SW, SP, and SM according to ASTM D2487, or a combination of these groups; free of rock or gravel larger than 3 inches (75 mm) in any dimension, debris, waste, frozen materials, vegetation, and other deleterious matter.
   ii. Compact soil materials to not less than 95 percent of maximum dry unit weight according to ASTM D1557.

7.0 Construction. With the site fully prepared, erection of the precast panels can begin. Using a small crane, the sequence of erection of the precast panels is as follows:

a. Foundation panels are sequentially placed and leveled in the foundation excavation. A bonding agent is applied to the ends of the panels, and, each panel is then bolted together, using hand or power tools, to form a continuous foundation around the residence. Levelness of the top of the foundation panels is checked to comply with ¼ inch in ten feet along the entire surfaces of the foundation panels. Once verified, wall panel erection can begin.
b. Wall panels are set on top of the foundation panels using polymer shims to level the panels. The shims provide a way of leveling the panels if the foundation panels are not level. Sequentially, the panels are set and bolted together using hand or power tools, and, plumbness is checked. Temporary bracing is used to support the panels as required. After all wall panels have been bolted together, roof panel erection can begin.
c. Roof panels are sequentially set on top of the wall panels. The roof panels are aligned with connection hardware on top of the wall panels. Using hand or power tools, bolts are connected through the top of the roof panel into the end of the wall panel. After all roof panels have been set, temporary wall bracing is removed.
d. This completes the precast erection. The structure is now stable.

7.1 Slab on Grade. With the precast structure complete, the residence is now considered "enclosed". Electrical and mechanical rough-in can now be completed within the residence. The electrical and mechanical rough-ins will be pre-packaged assemblies set in trenches below the slab. Sub-base material, stated above, will be placed and compacted within the mechanical and electrical trenches.

A sheet vapor retarder will then be placed over the sub-base material. The vapor retarder will be a Class A: ASTM E1745, not less than 10 mils (0.25 mm) thick. Manufacturer's recommended adhesive or pressure-sensitive tape will be applied to the lapped joints.

Welded-Wire-Fabric (WWF) will then be placed on top of the vapor retarder. The WWF size is typically 6×6—W1.4×W1.4. This will control the width of the cracks occurring in the concrete.

The field-poured concrete slab, typically 4 inches thick, will then be placed. As the concrete is poured, the WWF will be pulled-up into the wet concrete maintaining an approximate concrete cover of 1 inch from the top of the slab. Once the concrete has set, finishing operations of the concrete can begin. A dissipating curing compound will be sprayed or rolled onto the concrete surface.

The final floor finish will be trowel-finished concrete, with a flatness tolerance of ⅛ inch in ten feet anywhere of the surface of the slab. The floor finish will be selected by the customer.

7.2 Exterior Enclosure. Beginning after the entire precast structure is erected and stable, elastomeric sealant will be applied to the exterior precast wall panel joints (as shown above).

Polyisocyanurate roof insulation will then be applied to the top of the roof panels. The insulation will be fully-adhered to the concrete substrate. Thickness of the insulation will depend upon the location of the project. A minimum thickness of 1 inch will be used for all applications.

A single-ply roofing membrane will then be fully-adhered over the insulation. The roofing membrane material, depending on the location, will be either:

a. EPDM: Firestone Fullforce
   i. The wind uplift rating is 780 psf. This is well beyond Factory Mutual FM 1-180.
b. TPO: Thermoplastic Polyolefin, minimum 45 mil.
c. Build-up or "roll on" roofing may also be used in certain areas.

The exterior precast walls are painted with a high-grade paint per the customer's requirements.

8.0 Interior Build-Out. Interior walls are constructed of cold-formed-steel (CFS) studs with gypsum board. These walls are prefabricated and are connected to the concrete slab at the bottom of the wall. Prefabrication will take place in an enclosed, manufacturing setting. All studs are galvanized to prevent corrosion of the steel. In colder climates, a G60 galvanized coating will be used. In warmer, coastal climates, a G90 galvanized coating will be used.

Both sides of the walls will have factory-applied gypsum board up to 2½" from the top of the studs. The opposite side will have the gypsum board partially applied leaving a strip at the bottom of the wall for connection to the concrete structure. Base boards and plastic access panels will then be applied to fill the gypsum board leave-out strips on one side of the wall. Factory-applied wall coating or paper will also be applied to the gypsum board. This minimizes field finishing of the walls.

Electrical wiring packages and plumbing packages are factory-installed in the walls. Upon setting the wall panels, the wiring and plumbing is connected to the rough, stub-outs in the slab. This is all done within the wall cavity.

Doors are hung at this time. Final electrical switches are installed. Cabinetry and toilet fixtures/accessories are installed.

9.0 Completion. Final sealing of all walls, if required, will take place. Any touchup painting will be completed. Flooring, if required, will be installed. The residence is ready for occupancy.

10.0 Supplement 1

See attached pages for Unique Features of Hestia Tech's Safe and Affordable Precast Building System.

11.0 Supplement 2

See attached pages for the Interior Wall System.

12.0 Construction Documents

See the attached pages for complete set of drawings for architectural, structural, mechanical, electrical and plumbing systems.

Unique and proprietary use of engineered pre-cast concrete foundation, wall, roof panels manufactured in a factory setting. Unique and proprietary use of non-welded joinery systems to bind foundation, walls, and roof. In-field bolted assembly process utilizing relatively low-skilled labor for ease, speed, and safety of the erection process.

All panels are engineered and sized to transport to job site using standard trucks over public roadways without special permitting. Foundation, wall, and roof panels are sized to allow use of small cranes for erection.

Engineered specifically to resist wind, shaking and rain loads in accordance with the highest standards of international building codes. Inherent fire-resistant outer shell.

All interior components and mechanical systems designed for rapid deployment so a completed shell (foundation, wall, roof, windows, exterior doors) can be achieved within 2 days from site excavation and a completed home turned over to the homeowner within 30 days of site excavation.

No welding is required to join concrete wall or roof panels into a core structure (no risk of electrical hazard on site). Exchanges skilled job-site labor to build forms and pour concrete on site for manual labor within factory. Manufacturing in a factory setting creates an environment for a more consistent, higher quality product than field constructed products.

System is engineered to use a minimum number unique precast panel. Many panels are replicated in each house design (2, 3- and 4-bedroom models) and many panels are interchangeable between models.

Instructions include proprietary order of assembly for foundations, exterior and interior panels, and roof panels which must be followed to complete assembly successfully.

Use of factory assembled electrical and plumbing assemblies to reduce field labor. Use of in-house factory assembled electrical and plumbing assemblies exchanges high cost field tradesman for lower cost, lower skilled factory workers. High volume, automated manufacturing (projected installation at one house per day) required to reach efficiencies of scale.

The layout and placement of wall panels over the foundation panels is specifically engineered to distribute wall and roof loads more evenly to the foundation panels.

Shell is a concrete structure that can be erected in subzero weather. Shell is a concrete structure that can be field assembled in rainy conditions (no threat of electrical shock from field welding wall or roof panel connections).

Proprietary interior track design which allows engineered, prefabricated interior wall panels to roll into the home and "tip up" into place without wedging between the floor and ceiling.

Flat roof design on interior of home eliminates costly angled "gap fill" of matching walls to ceiling angles. Necessary to reduce costs and make structure affordable.

Prefabricated interior wall system moves high skilled, high cost job site labor into lower cost, lower skilled factory positions; these efficiencies are necessary to obtain a 30 day start to completion schedule.

Concrete structures are much more affordable to insure and maintain than conventional construction methods.

Standard precast components can be assembled in different arrangements to create various sized and shaped structures.

By changing liners in the precast forms, various textures and patterns can be introduced to a wall surface at minimal cost.

Sloping roof controls the flow of water which may be directed to a holding tank in areas with limited water sources.

Electrical and plumbing is contained within the wall areas of the structure, increasing eye appeal and safety.

Figure 6:
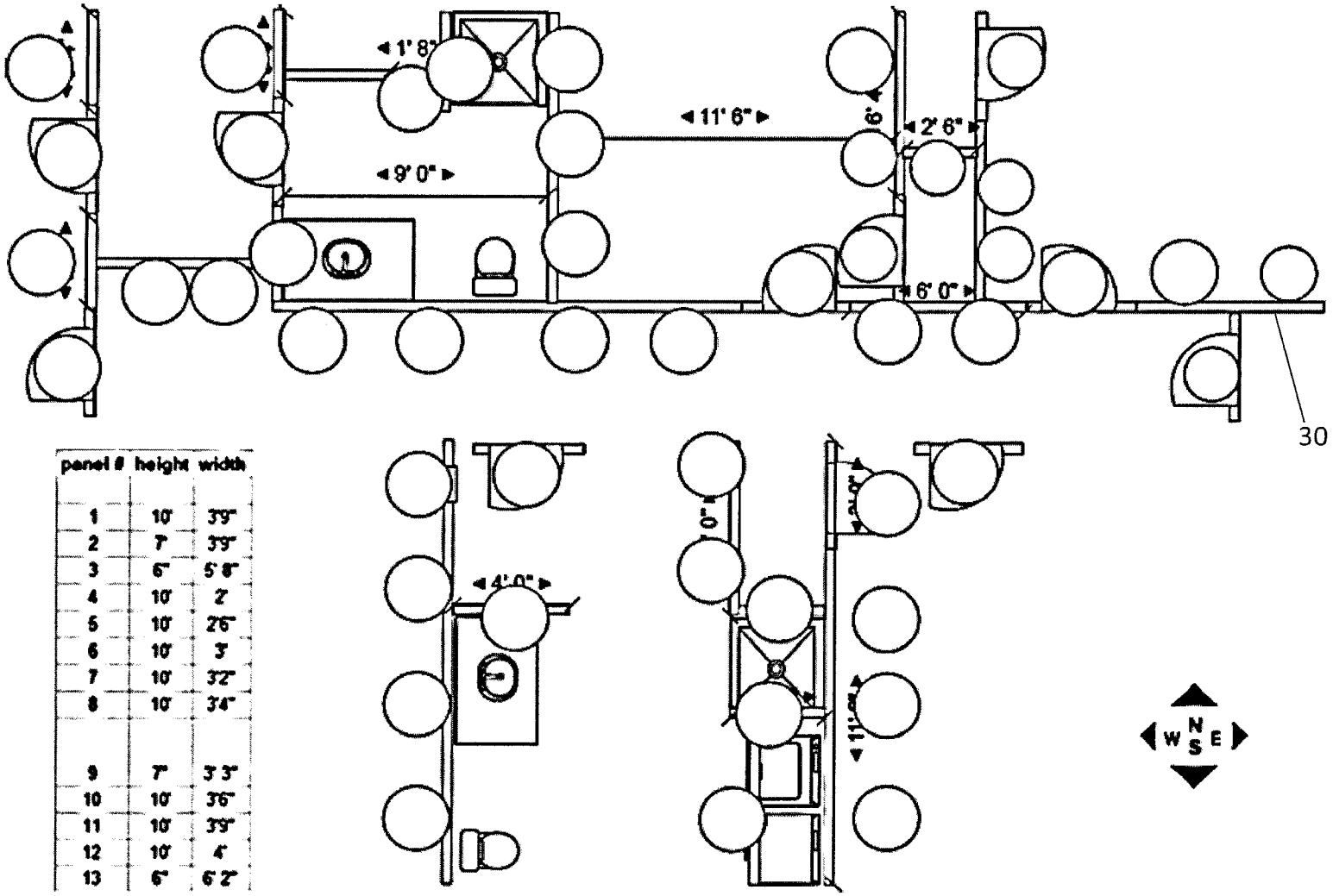
FIG. 6 shows a representative layout and sequence of installation of panels.

The interior wall panel installation, as shown in FIG. 6, is as follows:

Panel 1: Set back angle top facing west using powder actuated fastener (measure 5' 5" from east wall to back of angle against north wall; set 1 fastener; measure 5' 5" from east wall to back of angle against bearing wall, set fastener; complete fastening to deck). Tip up panel 1. Set front angle top. Plumb panel with level. Set back bottom angle. Set front bottom angle.

Panel 2: Set back angle top facing west using powder actuated fastener (measure 11' 6.5" from east wall to back of angle against north wall; set 1 fastener; measure 11' 6.5" from east wall to back of angle against hall wall, set fastener; complete fastening to deck). Tip up panel 2; set anti tip device against west face of panel. Plumb panel with level. Set short back angle bottom. Set short front angle bottom.

Panel 3: Tip up panel 3; set anti tip device against west face of panel. Plumb panel using level. Set long back angle with one powder actuated fastener at north end of angle and only fasten in front of panel).

Panel 4: Tip up panel 4; set anti tip device against west face of panel. Plumb panel using level. Set long back angle with one powder actuated fastener at north end of angle and only fasten in front of panel). Set front angle for panels 2, 3 and 4.

Panel 5: Set back angle top (note angle will be ½" wider than panel to allow drywall to fit flush against perpendicular panels)(back of angle to face north wall). Tip up panel 5. Set front angle top. Plumb panel with level. Set back bottom angle. Set front bottom angle.

Panel 6: Set back angle top facing west using powder actuated fastener (measure 2'6½" from east wall to back of angle against north wall; set 1 fastener; measure 2'6½" from east wall to back of angle toward hall wall, set fastener; complete fastening to deck). Tip up panel 6; set anti tip device against west face of panel. Plumb panel with level. Set back angle bottom, fasten only in front of panel.

Panel 7: Tip up panel 7; set anti tip device against west face of panel.

Fasten bottom angle in front of panel.

Panel 8: Tip up panel 8; set anti tip device against west face of panel. Plumb panel using level. Set back bottom angle. Set long front bottom angle. Set back and front bottom short angles.

Panel 9: Bring panels 9, 10 and 11 into bedroom 2 and tilt up against east wall. Hold up top back angle against east wall to mark end toward west wall.

Set back top angle facing south against panels 4 and 8 and set to mark using powder actuated fastener. Set top back angle between first back angle and east wall facing north flush to first angle using powder actuated fastener. Tip up panel 9 set anti tip device against north face of panel. Plumb panel with level. Set back bottom angle.

Panel 10: Tip up panel 10 set anti tip device against north face of panel. Plumb panel with level. Set back bottom angle.

Panel 11: Tip up panel 11 set anti tip device against south face of panel. Set top front angle panels 9, 10 and 11. Plumb panel with level. Set back bottom angle.

Panel 12: Tip up panel 12 set anti tip device against south face of panel. Set front and back bottom angle.

Panel 13: Tip up panel 13 set anti tip device against south face of panel. Plumb panel with level. Set front bottom angle.

Panel 14: Tip up panel 14 set anti tip device against south face of panel. Set top front angle panels 12, 13 and 14. Plumb panel with level. Set front bottom angle panels 12, 13 and 14. Set back bottom angle.

Panel 15: Set back angle top facing west using powder actuated fastener (measure 9'½" from east wall to back of angle against north wall; set 1 fastener; measure 9'½" from east wall to back of angle toward hall wall, set fastener; complete fastening to deck). Tip up panel 15; set anti tip device against west face of panel. Plumb panel with level. Set back bottom angle in front of panel.

Panel 16: Tip up panel 16; set anti tip device against west face of panel. Plumb panel using level. Set back bottom angle in front of panel only.

Panel 17: Tip up panel 17. Set top front angle panels 15, 16 and 17. Plumb panel using level. Set back bottom angle. Set front bottom angle.

Panel 18: Set back angle top facing north using powder actuated fastener (measure 6" from center bearing wall to back of angle against bath wall (panel 17); set 1 fastener; measure 6' from center bearing wall to back of angle toward master wall, set fastener; complete fastening to deck). Tip up panel 18; set anti tip device against north face of panel. Plumb panel with level. Set back bottom angle in front of panel only.

Panel 19: Tip up panel 19. Set top front angle panels 18 and 19. Plumb panel with level. Set back bottom angle. Set front bottom angle.

Panel 20: Set back top angle against panel 19 and center bearing wall facing west using powder actuated fastener (measure 6' 1" from bath wall toward north wall). Tip up panel 20 set anti tip device against west face of panel. Plumb panel with level. Set back bottom angle.

Panel 21: Tip up panel 21 set anti tip device against west face of panel. Plumb panel with level. Set back bottom angle. Set front bottom angle panels 20 and 21.

Panel 22: Tip up panel 22 set anti tip device against west face of panel. Plumb panel with level. Set back bottom angle.

Panel 23: Tip up panel 23 set anti tip device against west face of panel. Plumb panel with level. Set back bottom angle. Set front angle panels 22 and 23. Set short front angle.

Panel 24: Set back angle top facing west using powder actuated fastener (measure 11'6½" from east wall to back of angle against north wall; set 1 fastener; measure 11'6½" from east wall to back of angle toward hall wall, set fastener; complete fastening to deck). Tip up panel 24; set anti tip device against west face of panel. Plumb panel with level. Set back bottom angle in front of panel.

Panel 25: Tip up panel 25; set anti tip device against west face of panel. Plumb panel using level. Set back bottom angle in front of panel only.

Panel 26: Tip up panel 26. Set front angle. Plumb panel using level. Set back angle bottom. Set long front angle bottom panels 24, 25 and 26.

Panel 27: Tip up panel 27; set anti tip device against west face of panel. Fasten back and front bottom angle.

Panel 28: Fasten panel to panel 27 and panel 15.

Panel 29: Replaced by panel 3 but I didn't rename all the following panels.

Panel 30: Bring in and stand up against center bearing wall panels 30-33. Set back angle top facing south using powder actuated fastener flush to panels 14, 17 and 26. Tip up panel 30; set anti tip device against south face of panel.

Panel 31: Set back angle top facing south using powder actuated fastener flush to panels 14, 17 and 26. Tip up panel 31; set anti tip device against south face of panel. Set top front angle panels 30 and 31. Set back bottom angle.

Panel 32: Tip up panel 32; set anti tip device against south face of panel.

Panel 33: Tip up panel 33; set anti tip device against south face of panel. Set top front angle panels 32 and 33. Set back and front bottom angle.

Door Panel 34: Install door in opening of center bearing wall into bedroom 3.

Door Panel 35: Install door in opening of center bearing wall into bathroom.

Panel 36: Set back angle top facing west using powder actuated fastener (measure 10' 8½" from east wall to back of angle against center bearing wall; set 1 fastener; measure 10' 8½" from east wall to back of angle toward south wall, set fastener; complete fastening to deck). Tip up panel 36; set anti tip device against west face of panel. Plumb panel with level. Set back bottom angle in front of panel only.

Panel 37: Tip up panel 37; set anti tip device against west face of panel. Plumb panel with level. Set back bottom angle in front of panel only.

Panel 38: Tip up panel 38; set anti tip device against west face of panel. Plumb panel with level. Set back bottom angle in front of panel only.

Panel 39: Tip up panel 39; set anti tip device against west face of panel. Set front top angle panels 36-39. Plumb panel with level. Set back bottom angle. Set front bottom angle.

Panel 40: Set back angle top facing south using powder actuated fastener (measure 5' 7½" from center bearing wall; set 1 fastener; measure 5' 7½" from center bearing wall to back of angle toward south wall, set fastener; complete fastening to deck). Tip up panel 40; set anti tip device against west face of panel. Set front top angle. Plumb panel with level. Set back bottom angle. Set front bottom angle.

Panel 41: Tip up panel 41; set anti tip device against south face of panel. Fasten back and front bottom angle. (Note panel 41 may need to go up to ceiling to carry shelf for water heater).

Panel 42: Fasten panel to panel 41 and south wall.

Panel 43: Set back angle top facing west using powder actuated fastener (measure 2' 8½" from bedroom 3 wall; set 1 fastener; measure 2' 8½" from bedroom 3 wall to back of angle toward south wall, set fastener; complete fastening to deck). Tip up panel 43; set anti tip device against west face of panel. Plumb panel with level. Set back bottom angle in front of panel only.

Panel 44: Tip up panel 44; set anti tip device against west face of panel. Set top front angle panels 43 and 44. Plumb panel with level. Set back bottom angle. Set front bottom angle.

Panel 45: Set back angle top facing south using powder actuated fastener (measure 5' 7½" from center bearing wall; set 1 fastener; measure 5' 7½" from center bearing wall to back of angle toward south wall, set fastener; complete fastening to deck). Tip up panel 45; set anti tip device against west face of panel.

Set top front angle. Plumb panel with level. Set back bottom angle in front of panel only.

Panel 46: Set back angle top facing west using powder actuated fastener (measure 9' 8½" from east wall to back of angle against center bearing wall; set 1 fastener; measure 9' 8½" from east wall to back of angle toward south wall, set fastener; complete fastening to deck). Tip up panel 46; set anti tip device against west face of panel. Plumb panel with level. Set back bottom angle in front of panel only.

Panel 47: Tip up panel 47; set anti tip device against west face of panel. Plumb panel with level. Set back bottom angle in front of panel only.

Panel 48: Tip up panel 48; set anti tip device against west face of panel. Plumb panel with level. Set back bottom angle in front of panel only.

Panel 49: Tip up panel 49; set anti tip device against west face of panel. Set top front angle panels 46, 47, 48 and 49. Plumb panel with level. Set back bottom angle. Set front bottom angle. End of interior wall panel erection.

Those of skill in the art will understand that various details of the invention may be changed without departing from the spirit and scope of the invention. Furthermore, the foregoing description is for illustration only, and not for the purpose of limitation, the invention being defined by the claims. For example, [Think of different ways someone else could achieve the same objective by using a substitute component, and define the component to encompass the different ways.

While the invention has been illustrated and described in detail in the foregoing drawings and description, the same is to be considered as illustrative and not restrictive in character, it being understood that only illustrative embodiments thereof have been show and described and that all changes and modifications that are within the scope of the following claims are desired to be protected.

All references cited in this specification are incorporated herein by reference to the extent that they supplement, explain, provide a background for or teach methodology or techniques employed herein.

What is claimed is:

1. A method of constructing a precast concrete habitable structure comprising:

providing a precast concrete panel construction location, providing a residential structure location, separate from the precast panel construction location, forming at the precast panel construction location:

a plurality of concrete foundation panels having a width and a length and a plurality of sides, and including a plurality of foundation panel connection members embedded within the concrete of at least two different sides of the concrete foundation panel;

a plurality of concrete support wall panels having a depth and a height, a top and a bottom, and including a plurality of wall panel connection members embedded within the concrete of at least the bottom of the concrete support wall panel, and wherein at least one of the concrete support wall panels includes a door opening, and wherein at least one of the concrete support wall panels includes a window opening, a plurality of concrete roof panels having a center edge at one end, an exterior edge at an opposite end, and two side edges, the center edge having a thickness greater than the exterior edge and including an interior surface, an exterior surface and a plurality of roof panel connection members embedded within the concrete along each of the center edges and the side edges of the concrete roof panel, transporting the concrete foundation panels to the residential structure location, laying the foundation panels on a ground surface at the residential structure location such that a respective edge of each foundation panel abuts another foundation panel and such that the foundation panel connection members of the abutting foundation panels align with each other to thereby form an enclosed foundation for the residential structure, using the foundation panel connection members to bolt the abutting edges of each foundation panel to each other, pouring a concrete slab on grade into the enclosed foundation defined by foundation panel walls to create a floor and allowing the concrete slab to cure to thereby form a slab foundation, transporting the support wall panels to the residential structure location, positioning the support wall panels onto the enclosed foundation formed by the abutting foundation panels, such that the bottom edge of each support wall panel abuts the foundation formed by the abutting foundation panels, each support wall panel has an edge abutting an edge of another support wall panel such that the panel connection members of the abutting support wall panels align with each other, using the wall panel connection members to bolt the abutting edges of each support wall panel to each other, transporting the roof panels to the residential structure location, positioning the roof panels so the roof panels are supported by the wall support panels, the center edge of each roof panel abuts a center edge of another roof panel such that the roof panel connection members of the center edges of the abutting roof panels align with each other, and a side edge of each roof panel abuts a side edge of another roof panel such that the roof panel connection members of the side edges of the roof panels align with each other, to thereby form a sloped roof, using the roof panel connection members to bolt the abutting center edges of each roof panel to each other, using the roof panel connection members to bolt the abutting side edges of each roof panel to each other, using the roof panel connection members to bolt each roof panel to at least one support wall panel, to thereby form an enclosed residential structure; and wherein each said panel connection member comprises a straight coil loop embedded in a respective said panel and having an opening to an outer surface of the respective panel, the straight coil loop being aligned with a threaded coil embedded in a respective said abutting panel and connected therewith by a threaded bolt, wherein each said panel connection member is connected to each respective panel without welding at the residential structure location, and wherein the enclosed residential structure is configured to resist wind speeds of up to 220 miles per hour.

2. The method of claim 1 further comprising the step of:

attaching a door to the door opening of the at least one support wall panel a that includes the door opening before the at least one support wall panel is transported to the residential structure location.

3. The method of claim 1 further comprising the step of:

attaching a window to the window opening of the at least one support wall panel that includes the window opening before the at least one support wall panel is transported to the residential structure location.

4. The method of claim 1 wherein:

an interior wall is formed by one or more of the support wall panels; and the interior wall supports the center edges of one or more of the plurality of the roof panels.

5. The method of claim 1 wherein transporting each of the panels comprises:

loading each of the panels on to a vehicle having sides and a bed, such that the width of each of the panels extending from the sides of the vehicle does not exceed eight and one half feet, and such that the height of each of the panels on the bed does not exceed thirteen and one half feet.

6. The method of claim 1 further comprising the steps of:

manufacturing interior wall panels at the panel construction location, transporting the interior wall panels to the residential structure location, and after the enclosed residential structure is formed, moving the interior wall panels into the enclosed residential structure and bolting the interior wall panels to the slab foundation.

7. The method of claim 6 wherein one or more of the interior wall panels is connected to a ceiling or floor formed by one or more of the foundation, support wall or roof panels utilizing the following steps:

providing a first ceiling bracket having a top, a side and at least one receiving member;

providing a second ceiling bracket with at least one insertion member;

attaching the top of the first ceiling bracket to the ceiling so that the side of the first ceiling bracket is perpendicular to the floor;

providing a first floor bracket having a bottom and a side;

attaching the bottom of the first floor bracket to the floor so that the side of the first floor bracket is perpendicular to the floor and is vertically in line with the side of the first ceiling bracket;

providing a respective said interior wall panel having a top and a bottom;

attaching the second ceiling bracket to the top of the respective interior wall panel such that the insertion member is exposed at the top of the respective interior wall panel;

tilting the bottom of the respective interior wall panel against the first floor bracket until the respective interior wall panel is perpendicular to the floor and the insertion member of the second ceiling bracket is inserted into the receiving member of the first ceiling bracket;

providing a second floor bracket having a bottom and a side;

attaching the bottom of the second floor bracket to the floor such that the side of the second floor bracket abuts the respective interior wall panel on the opposite side of the first floor bracket.

* * * * *